US005713725A

United States Patent [19]

Kawaguchi et al.

[11] Patent Number: 5,713,725

[45] Date of Patent: Feb. 3, 1998

[54] CLUTCHLESS PISTON TYPE VARIABLE DISPLACEMENT COMPRESSOR

[75] Inventors: Masahiro Kawaguchi; Masanori Sonobe; Ken Suitou; Shinichi Ogura; Koji Kawamura, all of Kariya, Japan

[73] Assignee: Kabushiki Kaisha Toyoda Jidoshokki Seisakusho, Kariya, Japan

[21] Appl. No.: 438,841

[22] Filed: May 11, 1995

Related U.S. Application Data

[63] Continuation-in-part of Ser. No. 421,215, Apr. 13, 1995, Pat. No. 5,584,670, which is a continuation-in-part of Ser. No. 361,111, Dec. 21, 1994, Pat. No. 5,603,610, which is a continuation-in-part of Ser. No. 255,043, Jun. 7, 1994, abandoned.

[30] Foreign Application Priority Data

May 12, 1994 [JP] Japan ..... 6-098952
Oct. 7, 1994 [JP] Japan ..... 6-244396

[51] Int. Cl.[6] ..... F04B 1/29

[52] U.S. Cl. ..... 417/222.2; 417/295

[58] Field of Search ..... 417/222.1, 222.2, 417/295, 269

[56] References Cited

U.S. PATENT DOCUMENTS 5,173,032 12/1992 Taguchi et al. ..... 417/222.2

FOREIGN PATENT DOCUMENTS 4034686 5/1991 Germany .
4439512 5/1995 Germany .
4446087 6/1995 Germany .
4446832 6/1995 Germany .

*Primary Examiner*—Timothy Thorpe
*Assistant Examiner*—Peter G. Korytnyk
*Attorney, Agent, or Firm*—Brooks Haidt Haffner & Delahunty

[57] ABSTRACT

A compressor has an internal refrigerant gas passage selectively connected to and disconnected with an external refrigerant circuit separately provided from the compressor. The compressor has a reciprocable piston in a cylinder bore formed in a housing for compressing gas supplied from the external refrigerant circuit to the internal refrigerant gas passage. A drive shaft is rotatably supported by the housing. A swash plate is supported on the drive shaft for integral rotation with and inclining motion with respect to the drive shaft. The swash plate is movable between a maximum incline and a minimum incline. A disconnecting apparatus disconnects the internal refrigerant gas passage from the external refrigerant circuit when the swash plate is at its minimum incline. A restricting member restricts the amount of gas to be passed through the internal refrigerant gas passage in association with the disconnecting apparatus when the swash plate moves.

23 Claims, 27 Drawing Sheets

CLUTCHLESS PISTON TYPE VARIABLE DISPLACEMENT COMPRESSOR

CROSS REFERENCE TO RELATED APPLICATION

This application is a continuation-in-part of U.S. patent application Ser. No. 08/421,215 filed Apr. 13, 1995, now U.S. Pat. No. 5,584,670 which is a continuation-in-part of U.S. patent application Ser. No. 08/361,111 filed Dec. 21, 1994 now U.S. Pat. No. 5,603,610 which is a continuation-in-part of U.S. patent application Ser. No. 08/255,043 filed June 7, 1994, now abandoned, all of which are incorporated herein by reference.

BACKGROUND OF THE INVENTION

1. Field of the Invention

The present invention relates to a clutchless piston type variable displacement compressor. More specifically, this invention relates to a clutchless piston type variable displacement compressor which controls the inclined angle of a swash plate based on the difference between the pressure in a crank chamber and suction pressure, supplies the gas in the discharge pressure area to the crank chamber and discharges the gas in the crank chamber to the suction pressure area, thereby adjusting the pressure in the crank chamber.

2. Description of the Related Art

In general, a compressor is mounted in a vehicle to air-condition its passenger compartment. To keep the passengers comfortable by accurately controlling the temperature in the compartment, it is desirable to use a compressor which is designed so that the discharge displacement of the refrigerant gas is controllable. One known compressor of this type controls the inclined angle of the swash plate, tiltably supported on the drive shaft, based on the difference between the pressure in the crank chamber and suction pressure and converts the rotational movement of the swash plate to linear reciprocative movement of pistons.

The conventional piston type compressor disclosed in U.S. Pat. No. 5,173,032 does not use any electromagnetic clutch for either the transmission or disengagement of power from an external driving source to its drive shaft. The external driving source is coupled directly to the drive shaft.

A direct connection between the driving source and drive shaft effectively eliminates shocks caused by the ON/OFF action of a clutch. This tends to improve passenger comfort. The clutchless structure also contributes to a reduction in the overall weight and cost of the cooling system.

In such a clutchless system, the compressor runs even when no cooling is needed. With such a compressor, it is important that when cooling is unnecessary, the discharge displacement be reduced as much as possible in order to prevent the evaporator from undergoing frosting. Likewise, under these conditions, it is also important to stop the circulation of refrigerant gas through the compressor and its external refrigeration circuit when no cooling is necessary or there is a chance that the frosting of the evaporator will occur. The compressor described in the aforementioned U.S. patent is designed to block the flow of gas into the suction chamber in the compressor from the external refrigeration circuit with the use of an electromagnetic valve. This valve selectively allows for the circulation of the gas through the external refrigeration circuit and the compressor.

When the gas flow to the suction chamber from the external refrigeration circuit is blocked in this type of compressor, the pressure in the suction chamber drops and the control valve responsive to that pressure opens fully. The full opening of the control valve allows the gas in the discharge chamber to flow into the crank chamber, which in turn raises the pressure inside the crank chamber. The gas in the crank chamber is supplied to the suction chamber. Accordingly, a short circulation path passing through the cylinder bores, the discharge chamber, the crank chamber, the suction chamber and back to the cylinder bores is formed.

As the pressure in the suction chamber decreases, the suction pressure in the cylinder bores falls, causing an increase in the difference between the pressure in the crank chamber and the suction pressure in the cylinder bores. This pressure differential in turn minimizes the inclination of the swash plate which reciprocates the pistons. As a result, the compressor's discharge displacement, driving torque and power loss are minimized during times when cooling is unnecessary.

When the refrigerant gas starts flowing again into the suction chamber of the compressor from the external refrigeration circuit, the pressure in the suction chamber rises and the displacement control valve responsive to that pressure closes. The closing of the displacement control valve blocks the flow of the refrigerant gas into the crank chamber from the discharge chamber, thus reducing the pressure in the crank chamber. As the pressure in the suction chamber rises, the suction pressure in the cylinder bores also rises. As a result, the difference between the pressure in the crank chamber and the suction pressure in the cylinder bores becomes smaller, which in turn, increases the inclined angle of the swash plate.

In the clutchless type compressor, the difference between the maximum and minimum values of the load torque is large. Therefore, a vehicle with such a compressor has an inherent problem with engine stalling. Engine stall is caused by the load torque necessary for driving auxiliary machines other than the compressor such as an alternator or an oil pump for a powered steering mechanism. The causes for engine stall are eliminated by the use of an idle speed controller. This controller adjusts the amount of air supplied to the engine while idling to control the speed of the idling engine (hereinafter simply called idling engine speed) to a target value. The target value when a load is applied to the engine by an auxiliary machine is set higher than the idling engine speed when no such load torque is applied. Thus, engine stall is avoided.

The controller performs feedback control to set the engine speed to the target value while sampling the engine speed. When the load of the compressor on the engine drastically increases, therefore, the engine speed may go beyond the feedback control of the controller causing the engine to stall. The compressor disclosed in the above-described U.S. Pat. No. 5,173,032 neither teaches nor suggests how to avoid the occurrence of engine stall caused by the increased torque needed to drive the compressor.

SUMMARY OF THE INVENTION

Accordingly, it is a primary objective of the present invention to provide a compressor capable of suppressing a drastic increase or change in load torque when the engine is idling in the case where the compressor is coupled to the engine of a vehicle.

To achieve the above objects, the compressor according to the present invention has an internal refrigerant gas passage selectively connected to and disconnected from an external refrigerant circuit separately provided from the compressor.

The compressor has a reciprocable piston in a cylinder bore formed in a housing for compressing gas supplied from the external refrigerant circuit to the internal refrigerant gas passage. A drive shaft is rotatably supported by the housing. A swash plate is supported on the drive shaft for integral rotation with and inclining motion with respect to the drive shaft. The swash plate is movable between a maximum incline and a minimum incline. A disconnecting means disconnects the internal refrigerant gas passage from the external refrigerant circuit when the swash plate is at its minimum incline. A restricting means restricts the amount of gas to be passed through the internal refrigerant gas passage in association with the disconnecting means when the swash plate moves.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
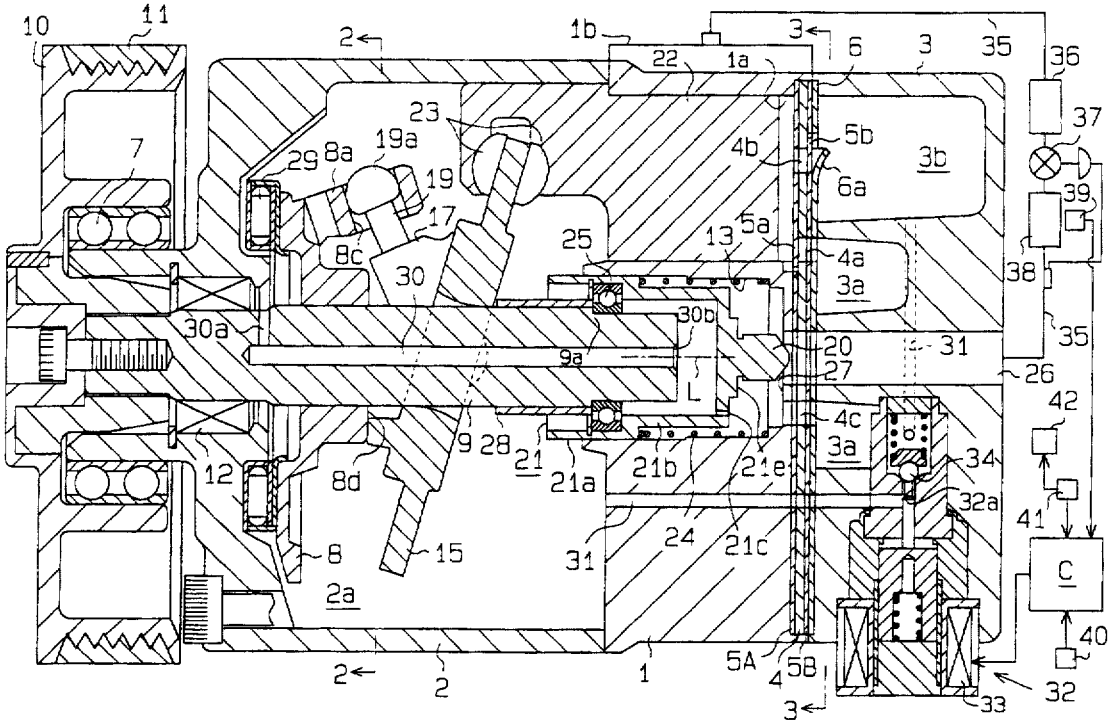
FIG. 1 is a side cross-sectional view of the overall compressor according to a first embodiment of the present invention.

A first embodiment of the present invention will now be described with reference to FIGS. 1 through 7. As shown in FIG. 1, a cylinder block 1 constitutes a part of the housing of the compressor. A front housing 2 is fixed to the front end of the cylinder block 1. A rear housing 3 is secured to the rear end of the cylinder block 1 via a first plate 4, a second plate 5A, a third plate 5B and a fourth plate 6. The front housing 2 has a crank chamber 2*a*. A rotary shaft 9 is rotatably supported in the front housing 2 and cylinder block 1.

The front end of the rotary shaft 9 protrudes from the crank chamber 2*a*, and supports a driven pulley 10. The pulley 10 is coupled to the engine of a vehicle via a belt 11. The pulley 10 is supported in the front housing 2 via an angular bearing 7. The front housing 2 receives the load in the thrust direction and the load in the radial direction, both acting on the pulley 10 via the angular bearing 7.

Figure 2:
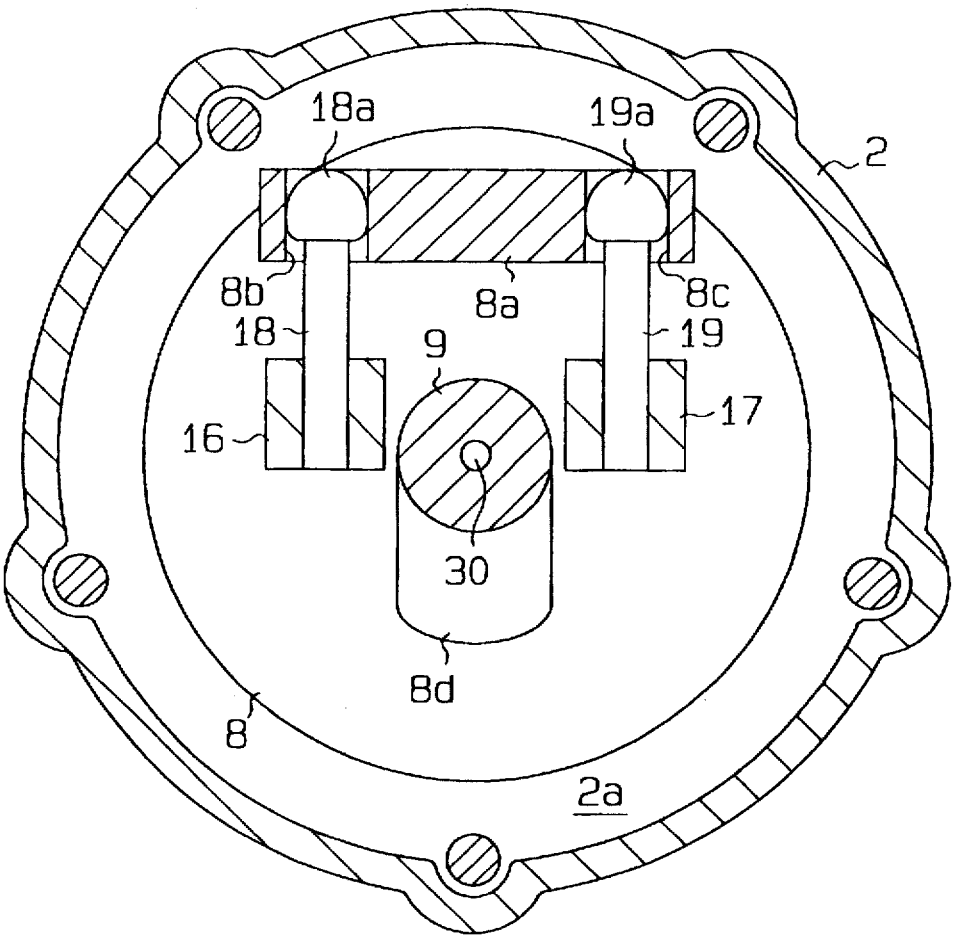
FIG. 2 is a cross-sectional view taken along the line 2—2 in FIG. 1.

Between the front end of the rotary shaft 9 and the front housing 2 is a lip seal 12, which prevents gas leakage from the crank chamber 2*a*. A rotary support 8 is secured to the rotary shaft 9, and a swash plate 15 is supported on the rotary shaft 9 so that it is slidable along the axis of the rotary shaft 9. As shown in FIG. 2, a pair of stays 16 and 17 are secured to the swash plate 15, and a pair of guide pins 18 and 19 are fixed to the stays 16 and 17, respectively. Guide balls 18*a* and 19*a* are formed at the distal ends of the respective guide pins 18 and 19. The rotary support 8 has a protruding support arm 8*a*. A pair of guide holes 8*b* and 8*c* are formed in the arm 8*a*, and the guide balls 18*a* and 19*a* of the guide pins 18 and 19 are slidably fitted in the associated guide holes 8*b* and 8*c*. The cooperation of the arm 8*a* and the guide pins 18 and 19 permits the swash plate 15 to tilt with respect to the rotary shaft 9 and rotate together with the drive shaft 9. The inclination of the swash plate 15 is guided by the support arm 8*a*, the guide pins 18 and 19 and the rotary shaft 9.

Figure 4:
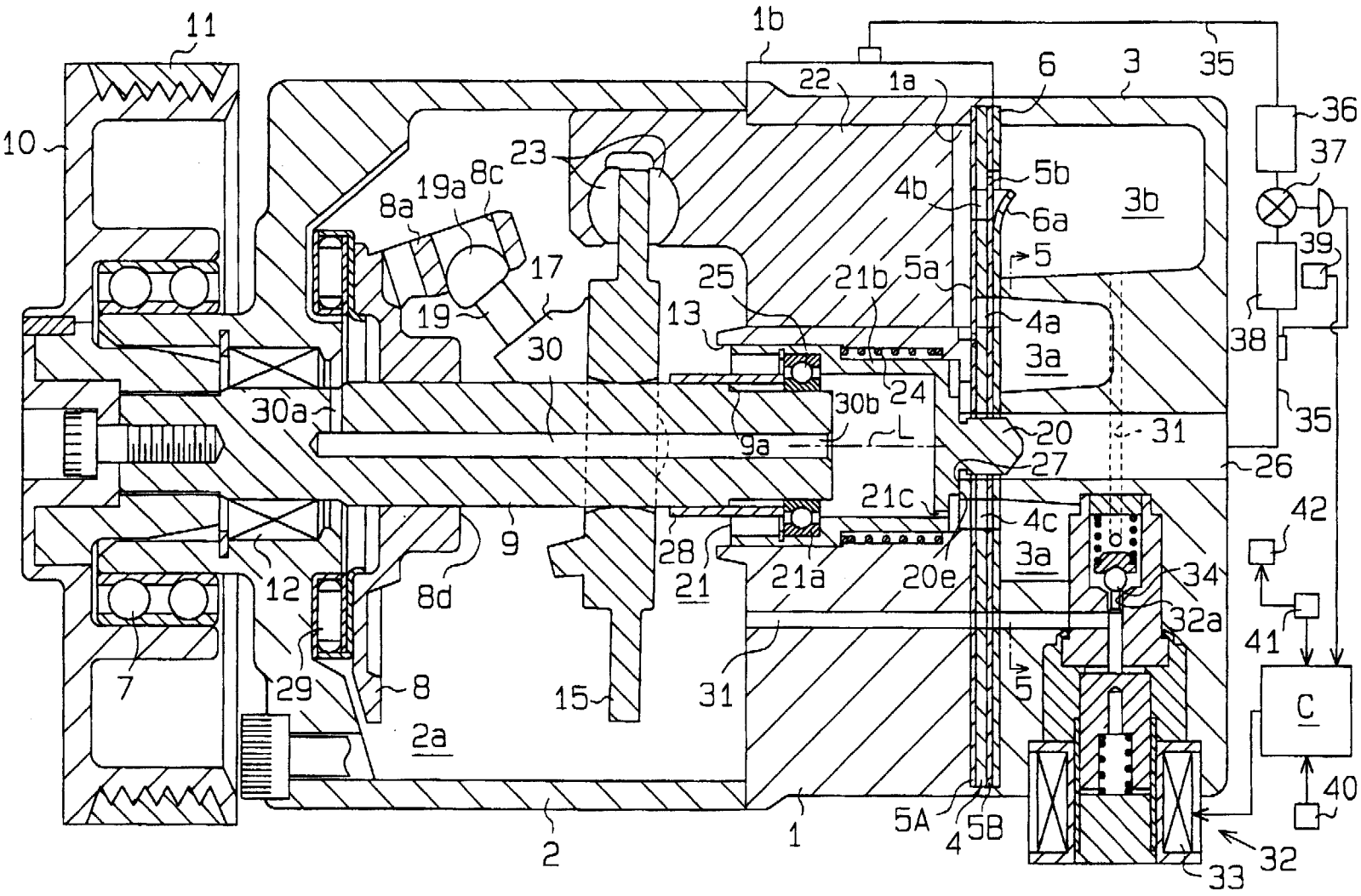
FIG. 4 is a side cross-sectional view of the overall compressor when the inclined angle of a swash plate is minimum.
Figure 6:
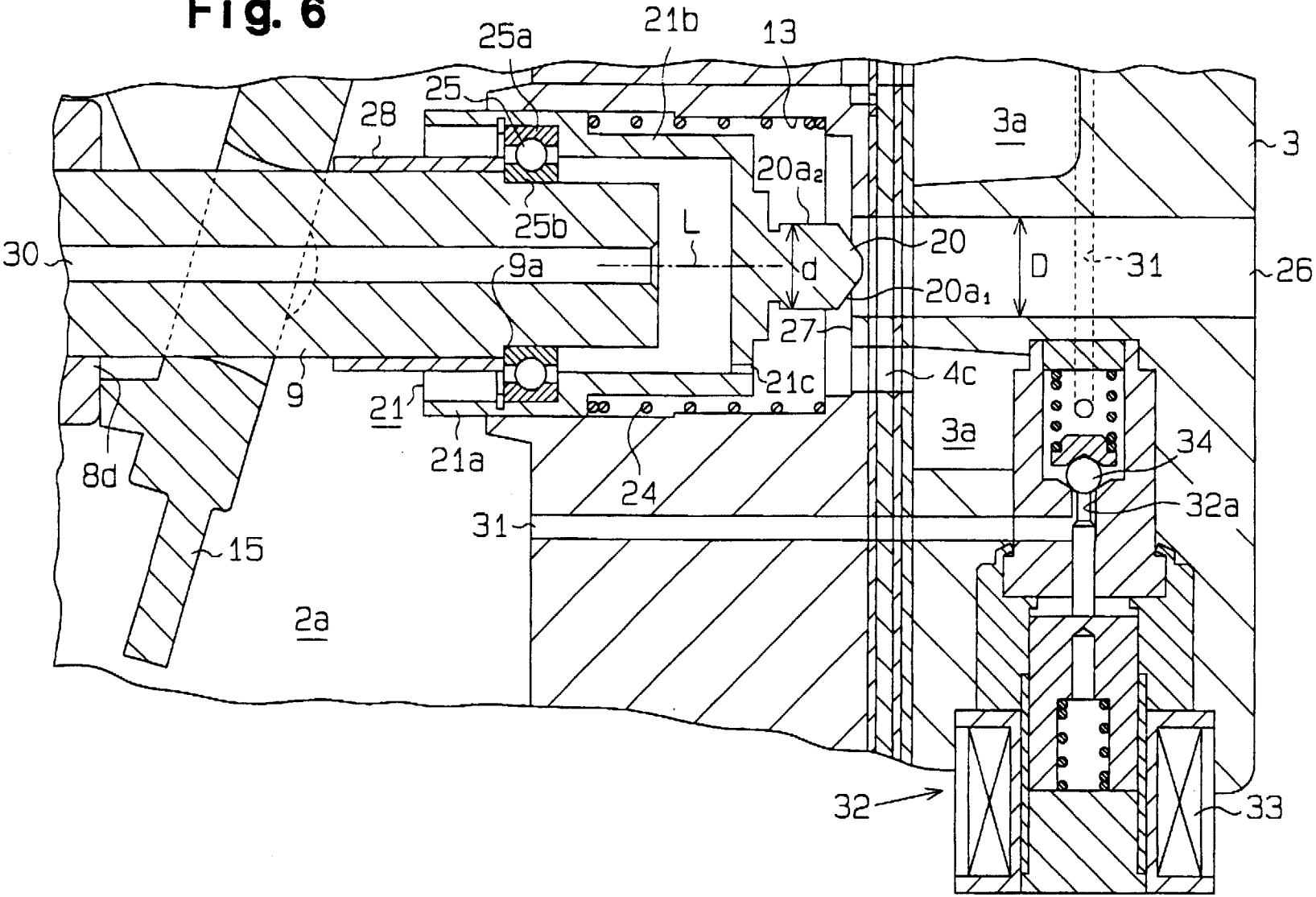
FIG. 6 is an enlarged partial cross-sectional view of the compressor when the inclined angle of a swash plate is maximum.

As shown in FIGS. 1, 4 and 6, a retaining hole 13 is formed in the center portion of the cylinder block 1 and extends along the axial line L of the rotary shaft 9. A cylindrical shutter chamber 21 is slidably accommodated in the retaining hole 13. The shutter member 21 is hollow, has a large diameter portion 21*a*, and a small diameter portion 21*b* with a step portion therebetween. A spring 24 is interposed between the step portion and the inner wall of the retaining hole 13. The spring 24 urges the shutter member 21 frontward or toward the swash plate 15.

The rear end of the rotary shaft 9 is supported inside the shutter member 21. A ball bearing 25 is located between the rear end of the drive shaft 9 and the inner wall of the large diameter portion 21*a* of the shutter member 21. The rear end of the rotary shaft 9 is supported by the inner wall of the retaining hole 13 via the ball bearing 25 and the shutter member 21. The ball bearing 25 has an outer race 25*a* fixed to the inner wall of the large diameter portion 21*a* and an inner race 25*b* which is slidable along the outer surface of the rotary shaft 9. As shown in FIG. 6, a step portion 9*a* is formed on the rear outer surface of the rotary shaft 9, and the frontward movement of the inner race 25*b* is stopped by the step portion 9*a*. Therefore, the whole ball bearing 25 is restricted from moving frontward by the step portion 9*a*. When the bearing 25 abuts on the step portion 9*a*, the frontward movement of the shutter member 21 is stopped.

Figure 3:
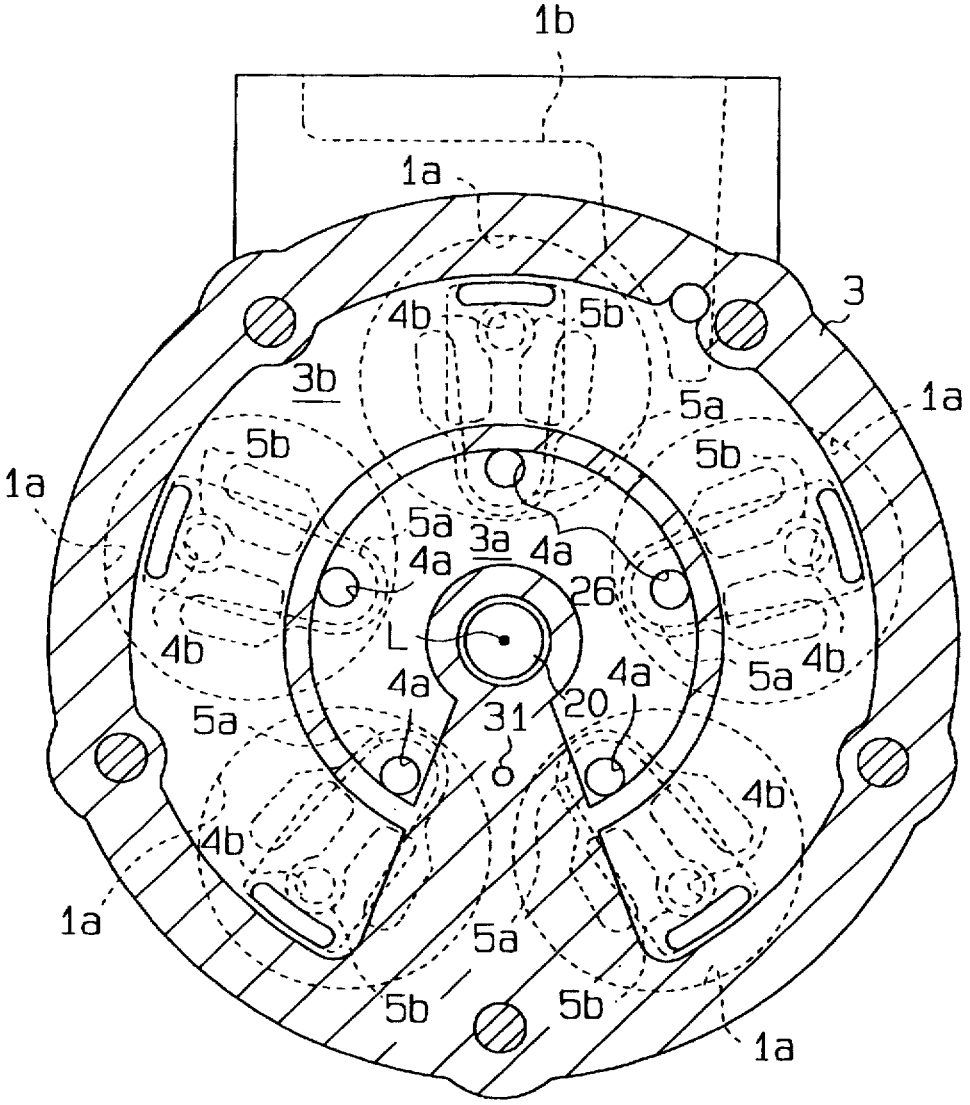
FIG. 3 is a cross-sectional view taken along the line 3—3 in FIG. 1.
Figure 5:
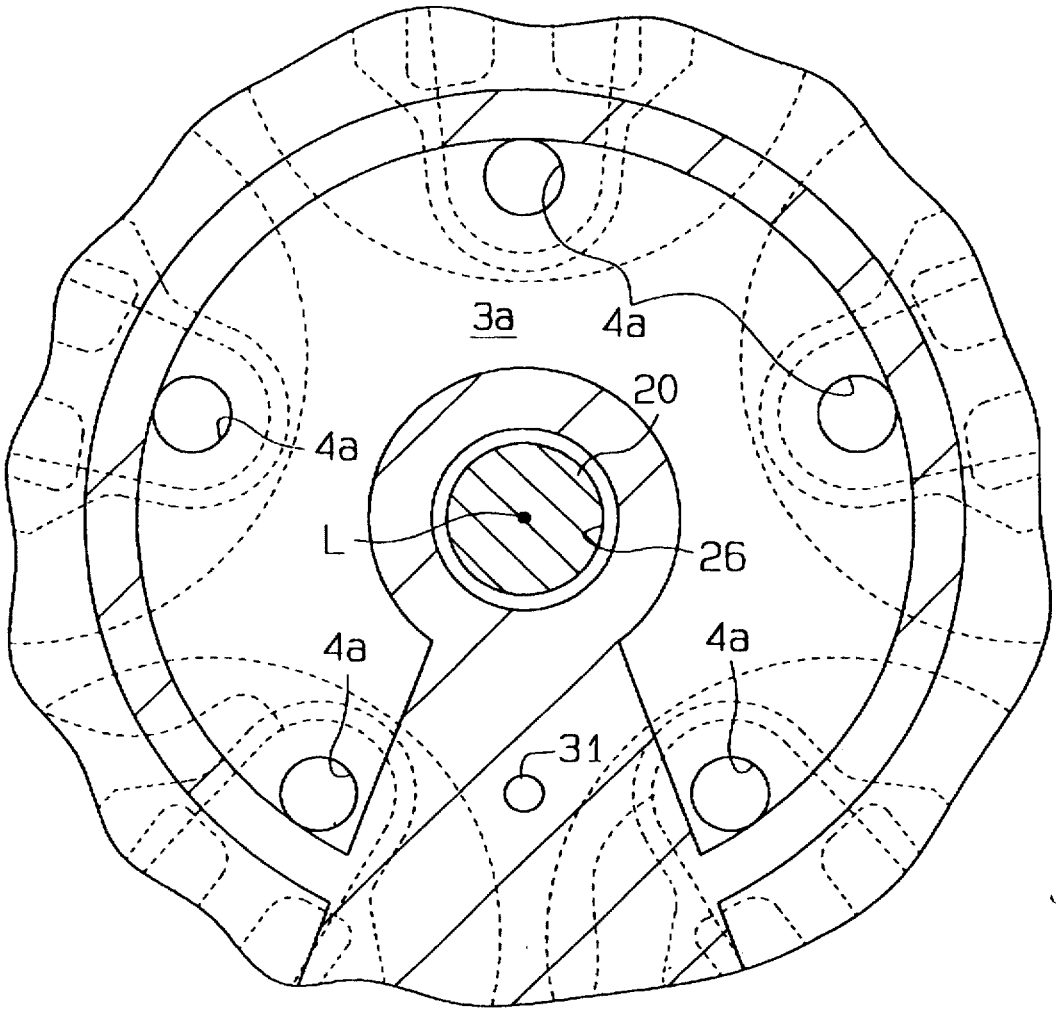
FIG. 5 is an enlarged cross-sectional view taken along the line 5—5 in FIG. 4.

A suction passage 26 is formed in the center portion of the rear housing 3. As shown in FIGS. 3 and 5, the center of the suction passage 26, which has a circular cross section, lies on the axis L of the rotary shaft 9. The suction passage 26 communicates with the retaining hole 13. A positioning surface 27 is formed around the inner opening of the suction passage 26. The rear end face, 21*e*, of the shutter member 21, at times, contacts the positioning surface 27. When the rear end face 21*e* contacts the positioning surface 27, rearward movement of the shutter member 21, or its movement away from the swash plate 15, is stopped and the rear end face 21*e*blocks the communication between the suction passage 26 and the retaining hole 13.

A restriction or a projection 20 is formed integrally with the rear end face 21*e* of the shutter member 21. The distal end of the restriction 20 has a conically tapered first surface $20a_1$. As shown in FIG. 6, the restriction 20 has a second surface $20a_2$ which has a circular cross section and whose center lies on the axis L of the rotary shaft 9. The outside diameter d of the restriction 20 is set slightly smaller than the inside diameter D of the suction passage 26, so that the restriction 20 can enter the suction passage 26.

A transmission pipe 28 is interposed between the swash plate 15 and the bearing 25 and is slidable on the shaft 9. The front end of the pipe 28 may contact the swash plate 15. The rear end of the pipe 28 contacts the inner race 25*b* but does not contact the outer race 25*a*.

As the swash plate 15 moves rearward or toward the shutter member 21, it abuts on the transmission pipe 28 and presses the pipe 28 against the inner race 25*b* of the ball bearing 25. The ball bearing 25 receives a load in the thrust direction as well as in the radial direction. The pressing of the pipe 28 causes the shutter member 21 to move rearward against the urging force of the spring 24. Consequently, the rear end face 21*e* of the shutter member 21 abuts on the positioning surface 27. Therefore, the minimum inclined angle of the swash plate 15 is restricted by the abutment of the rear end face 21*e* on the positioning surface 27. Thus, the shutter member 21, the ball bearing 25, the positioning surface 27 and the transmission pipe 28 constitute means for restricting the minimum inclined angle of the swash plate 15.

The minimum inclined angle of the swash plate 15 is slightly larger than zero degrees. The inclined angle of the swash plate 15 becomes minimum when the shutter member 21 comes to a closed position to disconnect the suction passage 26 from the retaining hole 13 (see FIG. 7). The shutter member 21 is movable in response to the swash plate 15 between this closed position and an open position (see FIG. 6) set apart in the frontward direction from the closed position where the suction passage 26 is opened. The maximum inclined angle of the swash plate 15 is restricted by the abutment of a projection 8*d* of the rotary support 8 on the swash plate 15.

Figure 7:
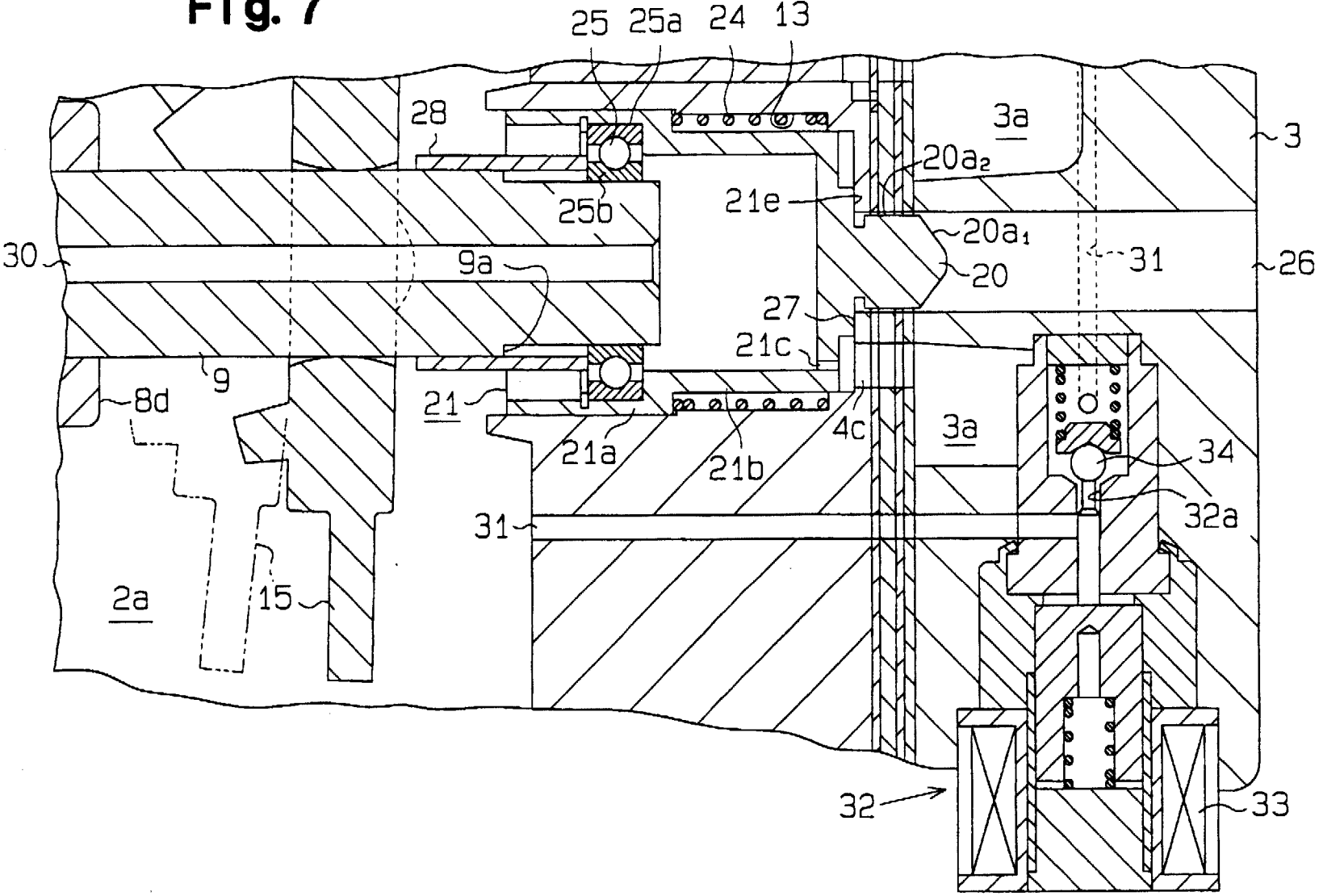
FIG. 7 is an enlarged partial cross-sectional view of the compressor when the inclined angle of a swash plate is minimum.

As shown in FIGS. 4 and 7, when the inclined angle of the swash plate 15 is minimum, the rear end face 21*e* of the shutter member 21 abuts on the positioning surface 27 and the restriction 20 is positioned in the suction passage 26. When the inclined angle of the swash plate 15 lies between the minimum inclined angle and the maximum inclined angle, as indicated by the broken line in FIG. 7, the restriction 20 is also positioned in the suction passage 26.

A plurality of cylinder bores la are formed through the cylinder block 1 in such a way as to communicate with the crank chamber 2*a*. Single-headed pistons 22 are placed in the associated cylinder bores 1*a*. The rotational movement of the swash plate 15 is converted by shoes 23 to reciprocal movement of the pistons 22. Accordingly, each piston 22 reciprocates in its associated cylinder bore 1*a*.

As shown in FIGS. 1 and 3, a suction chamber 3*a* and a discharge chamber 3*b* are defined in the rear housing 3. A suction port 4*a* and a discharge port 4*b* are formed in the first plate 4. A suction valve 5*a* is formed on the second plate 5A, and a discharge valve 5*b* on the third plate 5B. As the piston 22 moves backward, the refrigerant gas in the suction chamber 3*a* forces the suction valve 5*a* back and flows into the associated cylinder bore 1*a* from the suction port 4*a*. As the piston 22 moves forward, the refrigerant gas which has entered the cylinder bore 1*a* forces the discharge valve 5*b* back to be discharged into the discharge chamber 3*b* through the discharge port 4*b*. The discharge valve 5*b* abuts on a retainer 6*a* on the fourth plate 4 so that the opening degree is restricted.

A thrust bearing 29 is placed between the rotary support 8 and the front housing 2. This thrust bearing 29 receives the reaction force of the compressed gas that acts on the rotary support 8 via the pistons 22, the shoes 23, the swash plate 15, the stays 16 and 17 and the guide pins 18 and 19.

The suction chamber 3*a* communicates with the retaining hole 13 via a communication hole 4*c*. When the shutter member 21 is in the closed position, the communication hole 4*c* is blocked from the suction passage 26. The suction passage 26 serves as an inlet to supply the refrigerant gas into the compressor, and the shutter member 21 blocks the passage of the refrigerant gas between the suction passage 26 and the suction chamber 3*a*, at a point downstream of the suction passage 26.

A passage 30 is formed in the rotary shaft 9. The passage 30 has an inlet 30*a* open to the crank chamber 2*a* in the vicinity of the lip seal 12, and an outlet 30*b* open to the interior of the shutter member 21. As shown in FIGS. 1, 4 and 6, a pressure release hole 21*c* is formed in the distal end of the shutter member 21. This hole 21*c* permits the interior of the shutter member 21 to connect to the retaining hole 13.

As shown in FIGS. 1 and 4, the discharge chamber 3*b* and the crank chamber 2*a* are connected together by a supply passage 31. An electromagnetic valve 32 is disposed in the passage 31 to open or close the passage 31. When the solenoid, 33, of the electromagnetic valve 32 is excited, a valve body 34 closes a valve hole 32*a*. When the solenoid 33 is de-excited, the valve body 34 opens the valve hole 32*a*.

The refrigerant gas is discharged outside the compressor from the discharge chamber 3*b* through an outlet port 1*b*. An external refrigeration circuit 35 connects this outlet port 1*b* to the suction passage 26. The external refrigeration circuit 35 is equipped with a condenser 36, an expansion valve 37 and an evaporator 38. The expansion valve 37 controls the flow rate of the refrigerant in accordance with a change in gas pressure on the outlet side of the evaporator 38. A temperature sensor 39 is located near the evaporator 38. The temperature sensor 39 detects the temperature in the evaporator 38, and sends information about the temperature to a computer C.

The computer C controls the solenoid 33 of the electromagnetic valve 32. More specifically, the computer C instructs the excitation or de-excitation of the solenoid 33 to prevent frosting from occurring in the evaporator 38 when an activation switch 40 of the air conditioning system is kept ON and when the detected temperature becomes equal to or below a preset value.

Connected to the computer C are the activation switch 40 and a speed sensor 41 which detects the engine speed. Upon reception of specific information indicating a variation in engine speed from the speed sensor 41 while the activation switch 40 is set ON, the computer C de-excites the solenoid 33. The computer C de-excites the solenoid 33 in accordance with the OFF action of the activation switch 40. Therefore, the output of the temperature sensor 39, the OFF signal from the activation switch 40 and the output of the speed sensor 41 are instruction signals to open the supply passage 31.

As shown in FIGS. 1 and 4, the speed sensor 41 is connected to an idle speed controller (hereinafter referred to as ISC) 42. The ISC 42 performs feedback control based on the information from the sensor 41 in order to adjust the speed of the idling engine (idling engine speed) toward a target speed. This is the duty ratio control for an actuator (not shown) for adjusting the amount of air supply.

An internal refrigerant gas passage is formed within the compressor extending from the gas suction passage 26 to the outlet port 1*b* via the cylinder bores 1*a*. The internal refrigerant gas passage is selectively connected to and disconnected from the external refrigerant gas circuit, depending on the cooling requirements of the air conditioning system. When the cooling requirements increase, the supply passage 31 is closed by the solenoid valve 32. As the pressure in the crank chamber 2*a* decreases, the inclined angle of the swash plate 15 increases and the shutter member 21 moves away from the positioning surface 27, connecting the internal refrigerant gas passage to the external refrigerant circuit 35. The internal refrigerant gas passage then extends from the gas suction passage 26 through the retaining hole 13 and the communication hole 4*c* into the suction chamber 3*a*. From the suction chamber 3*a*, the internal refrigerant gas passage continues to the cylinder bores 1*a*, the discharge chamber 3*b* and to the outlet port 1*b*. Refrigerant flows from the external refrigerant circuit 35, through the suction passage 16 into the internal refrigerant gas passage, and back to the external refrigerant circuit 35 via the outlet port 1*b*.

When the cooling requirements decrease, the solenoid valve 32 opens the supply passage 31. The pressure within the crank chamber increases and the swash plate 15 moves to its minimum inclined angle. The shutter member 21 moves toward the positioning surface 27, closing the suction passage 26 and disconnection the internal refrigerant gas passage from the external refrigerant circuit 35. A circulation path is formed in the internal refrigerant gas passage wherein the compressed refrigerant gas in the discharge chamber 3*b* flows through the supply passage 31 into the crank chamber 2*a*. From the crank chamber 2*a*, the gas flows through the inlet 30*a* into the passage 30 of the rotary shaft 9. The gas flows into the retaining hole 13 via the outlet 30*b* and the pressure release hole 21*c*. From the retaining hole 13, the gas flows through the communication hole 4*c* into the suction chamber 3*a*. From there, the gas flows into the cylinder bores 1*a*, the discharge chamber 3*b* and back to the crank chamber 2*a* through the supply passage 31.

This is explained in detail as follows:

FIGS. 1 and 6 show the solenoid 33 in the excited state in which the supply passage 31 is closed. Therefore, the refrigerant gas under high pressure in the discharge chamber 3*b* is not supplied into the crank chamber 2*a*. In this situation, the refrigerant gas in the crank chamber 2*a* simply flows out to the suction chamber 3*a* via the passage 30 and the pressure release hole 21*c* so that the pressure in the crank chamber 2*a* approaches the pressure in the suction chamber 3*a*, i.e., the suction pressure. As a result, the inclined angle of the swash plate 15 is held at the maximum level and the discharge displacement of the compressor is maximized. Since the refrigerant gas in the crank chamber 2*a* passes through the inlet 30*a* provided near the lip seal 12, the lubricating oil suspended in the refrigerant gas improves the lubrication and sealing between the lip seal 12 and the rotary shaft 9.

When the cooling load of the compressor becomes lower and the gas is discharged with the swash plate 15 kept at the maximum inclined angle, the temperature in the evaporator 38 falls and approaches the value that may cause frosting. When the temperature in the evaporator 38 becomes equal to or lower than the set value, the computer C instructs to de-excite the solenoid 33 based on the signal from the temperature sensor 39. When the solenoid 33 is de-excited, the supply passage 31 is opened to connect the discharge chamber 3*b* to the crank chamber 2*a*. Consequently, the refrigerant gas under high pressure in the discharge chamber 3*b* flows into the crank chamber 2*a* via the supply passage 31, thus raising the pressure in the crank chamber 2*a*. Consequently, the inclined angle of the swash plate 15 becomes smaller.

As the inclined angle of the swash plate 15 becomes smaller, the first surface $20a_1$ of the restriction 20 enters the suction passage 26. When the swash plate is inclined at a midway point indicated by the broken line in FIG. 7, the boundary between the first surface $20a_1$ and the second surface $20a_2$ is aligned with the positioning surface 27. At this time, the cross-sectional area Sa of the open portion of the suction passage 26 is equal to the difference between the cross-sectional area of the suction passage 26, $S_2=\pi(D/2)^2$, and the cross-sectional area of the restriction 20, $S_1=\pi(d/2)^2$, on the second surface $20a_2$. That is, $Sa=S_2-S_1$. The symbols Sa, $S_1$ and $S_2$ are not shown in the drawings. When the distal end of the restriction 20 starts entering the suction passage 26, the open cross-sectional area Sa is gradually restricted toward $S_2-S_1$ from $S_2$. This gradually reduces the amount of the refrigerant gas flowing into the suction chamber 3*a* from the suction passage 26.

While the swash plate 15 tilts to the point just before its inclined angle becomes minimum from the midway position indicated by the broken line in FIG. 7, the open cross-sectional area Sa in the suction passage 26 is $S_2-S_1$. Since the open gas-passage area Sa in the suction passage 26 is kept at $S_2-S_1$ even if the inclined angle of the swash plate 15 decreases, the amount of the refrigerant gas flowing into the suction chamber 3a from the suction passage 26 decreases gradually. As a result, the amount of the refrigerant gas sucked into the cylinder bores 1a from the suction chamber 3a also decreases gradually, and the discharge displacement decreases gradually. This causes the discharge pressure to fall gradually, which suppresses a significant change in the load torque of the compressor in a short period of time.

When the rear end face 21e of the shutter member 21 abuts on the positioning surface 27, the open gas-passage area Sa in the suction passage 26 becomes zero, thus inhibiting the flow of the refrigerant gas into the suction chamber 3a from the external refrigeration circuit 35 as shown in FIGS. 4 and 7. Since the minimum inclined angle of the swash plate 15 is not zero degrees, the refrigerant gas is still discharged into the discharge chamber 3b from the cylinder bores 1a even when the inclined angle of the swash plate 15 is minimized. The refrigerant gas discharged to the discharge chamber 3b from the cylinder bores 1a flows into the crank chamber 2a via the supply passage 31. The refrigerant gas in the crank chamber 2a flows into the suction chamber 3a via the passage 30 and the pressure release hole 21c, and the refrigerant gas in the suction chamber 3a drawn into the cylinder bores 1a to be discharged to the discharge chamber 3b.

At the minimum inclined angle of the swash plate 15, therefore, a circulation path circulating the discharge chamber 3b, the supply passage 31, the crank chamber 2a, the passage 30, the pressure release hole 21c, the suction chamber 3a and the cylinder bores 1a is formed in the compressor, and there are pressure differences among the discharge chamber 3b, the crank chamber 2a and the suction chamber 3a. Therefore, the refrigerant gas circulates along the circulation path and the lubricating oil suspended in the refrigerant gas lubricates the interior of the compressor.

When the cooling load of the compressor increases from the state shown in FIG. 7, the temperature in the evaporator 38 rises beyond the aforementioned set value. Based on this temperature change, the computer C instructs the excitation of the solenoid 33. When the supply passage 31 is closed by the excitation of the solenoid 33, the pressure in the crank chamber 2a falls in accordance with the pressure escape through the passage 30 and the pressure release hole 21c. As a result, the inclined angle of the swash plate 15 increases.

As the inclined angle of the swash plate 15 increases, the shutter member 21 is moved by the urging force of the spring 24 in response to the inclination of the swash plate 15. The rear end face 21e of the shutter member 21 therefore moves away from the positioning surface 27. This movement increases the open gas-passage area Sa in the suction passage 26 from zero to $S_2-S_1$. This cross-sectional area ($S_2-S_1$) does not change until the swash plate 15 moves to the midway position indicated by the broken line in FIG. 7. Because the open gas-passage area in the suction passage 26 is constant even when the inclined angle of the swash plate 15 increases, the amount of the refrigerant gas flowing into the suction chamber 3a from the suction passage 26 increases gradually. As a result, the amount of the refrigerant gas drawn into the cylinder bores 1a from the suction chamber 3a also increases gradually, and so does the discharge displacement. Consequently, the discharge pressure rises gradually and the load torque of the compressor does not vary significantly in a short period of time.

The ISC 42 performs feedback control to set the idling engine speed to the target value while sampling the information about engine speed output from the speed sensor 41. When the load on the compressor drastically increases, the idling engine speed falls quickly as in the prior art. The feedback control of the ISC 42 cannot follow up this rapid change, so the engine may stall or the computer C may frequently repeat the instruction to excite and de-excite the electromagnetic valve 32. According to this embodiment, however, there is a gentle increase in the load torque of the compressor while the inclined angle of the swash plate 15 changes to the maximum inclined angle from the minimum inclined angle. Therefore, the feedback control of the ISC 42 works well in response to a change in engine speed caused by the increase in the load of the compressor. Engine stall is thus very unlikely.

Even when the solenoid 33 is de-excited in the state in FIG. 6 due to the OFF action of the activation switch 40 or a rapid change in the engine speed, the inclined angle of the swash plate 15 decreases. When the activation switch 40 is switched ON or the drastic change in the engine speed is over in the state in FIG. 7, the solenoid 33 is excited and the inclined angle of the swash plate 15 increases if there is a cooling load.

When the engine stops, the compressor stops running and the solenoid 33 is de-excited. As a result, the inclined angle of the swash plate 15 becomes minimum and stays in that state.

In this embodiment, the passage of the refrigerant gas in the suction passage 26 is affected by the outside diameter d of the restriction 20 and the inside diameter D of the suction passage 26. It is however easy to properly set those diameters. The restriction 20 is integrally formed on the axis of the shutter member 21, and the suction passage 26 lies on the line extending from the moving path of the restriction 20. The outside diameter d of the restriction 20 is smaller than the inside diameter D of the suction passage 26. Even in the case where the axis of the shutter member 21 is slightly shifted from the axis of the suction passage 26, therefore, the restriction 20 smoothly enters or moves out of the suction passage 26. The suction passage 26 is thus restricted properly by the restriction 20.

Since the restriction 20 and the shutter member 21 are integrated, their actions can be synchronized easily by properly setting the length of the restriction 20. Since the restriction 20 protruding from the shutter member 21 enters or moves out of the suction passage 26, the shutter member 21 can be made shorter.

Further, the shutter member 21 is moved in response to the movement of the swash plate 15 to control the supply of the refrigerant gas into the suction chamber 3a from the external refrigeration circuit 35 in this embodiment. It is therefore possible to prevent the occurrence of frosting in the evaporator 38 when there is no cooling load and to effectively suppress a change in load torque when the inclined angle of the swash plate 15 varies. Although the opening and closing of the passage 31 may be frequently repeated due to a change in cooling load, the opening and closing actions do not generate shocks because the torque change is effectively suppressed.

Figure 8:
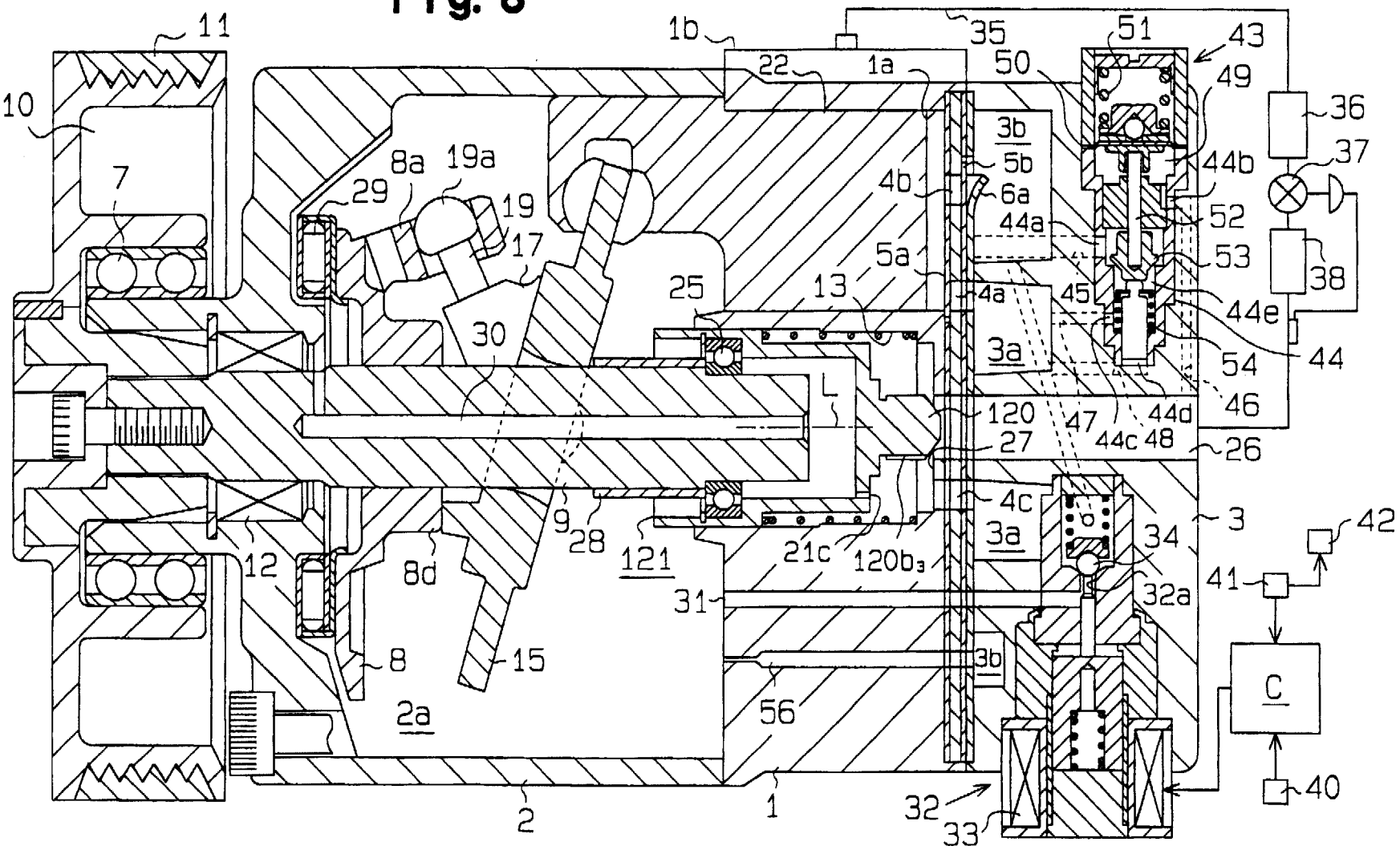
FIG. 8 is a side cross-sectional view showing the whole compressor according to another embodiment.

An embodiment shown in FIGS. 8 through 10 will now be described. In this embodiment, a displacement control valve 43 is attached to the rear housing 3 as shown in FIG. 8. The pressure in the crank chamber 2a is controlled by this control valve 43. A valve housing 44 which constitutes the control valve 43 is provided with a first port 44a, a second port 44b, a third port 44c and a fourth port 44d. The first port 44a communicates with the crank chamber 2a via a passage 45.

The second port 44b communicates with the suction passage 26 via a passage 46. The third port 44d communicates with the suction chamber 3a via a passage 47. The fourth port 44d communicates with the suction chamber 3b via a passage 48.

A chamber 49 for detecting the suction pressure communicates with the second port 44b. The pressure in this chamber 49 acts against an adjust spring 51 via a diaphragm 50. The urging force of the adjust spring 51 is transmitted to a valve body 53 via the diaphragm 50 and a rod 52. The urging force of a return spring 54 acts on the valve body 53 via a pressure sensitive member 55 in the fourth port 44d. This urging force of the return spring 54 acts in the direction to open a valve hole 44e. In accordance with a change in suction pressure in the chamber 49, the valve body 53 opens or closes the valve hole 44e. The discharge pressure acts on the pressure sensitive member 55, and the direction of the action is the same as the acting direction of the return spring 54. A pressure loss occurs in the suction pressure in the suction passage 26 due to the length of the path extending from the evaporator 38 to the suction passage 26. The greater the discharge pressure becomes, the larger the pressure loss becomes. The discharge pressure acting on the pressure sensitive member 55 compensates for the pressure loss in the suction pressure in the suction passage 26.

The discharge chamber 3b is connected to the crank chamber 2a via a restriction passage 56. When the suction pressure is high and the cooling load of the compressor is large while the solenoid 33 is excited to close the supply passage 31, the opening of the valve hole 44e opened by the valve body 53 increases. The high pressure refrigerant gas in the discharge chamber 3b flows into the crank chamber 2a via the restriction passage 56. As the opening of the valve hole 44e becomes larger, the amount of refrigerant gas flowing into the suction chamber 3a from the crank chamber 2a via the passage 30, a connection passage 21d, the passage 45, the valve hole 44e, the third port 44c and the passage 47 increases. As a result, the pressure in the crank chamber 2a falls. Since the suction pressure in the cylinder bores 1a is high, the difference between the pressure in the crank chamber 2a and the suction pressure in the cylinder bores 1a decreases. Accordingly, the inclined angle of the swash plate 15 becomes larger as shown in FIG. 8.

When the suction pressure is low and the cooling load is small, the opening of the valve hole 44e opened by the valve body 53 becomes smaller and the amount of the refrigerant gas flowing into the suction chamber 3a from the crank chamber 2a decreases. Consequently, the pressure in the crank chamber 2a rises. As the pressure in the cylinder bores 1a is low, the difference between the pressure in the crank chamber 2a and the suction pressure in the cylinder bores 1a increases. Therefore, the inclined angle of the swash plate 15 becomes smaller.

Figure 9:
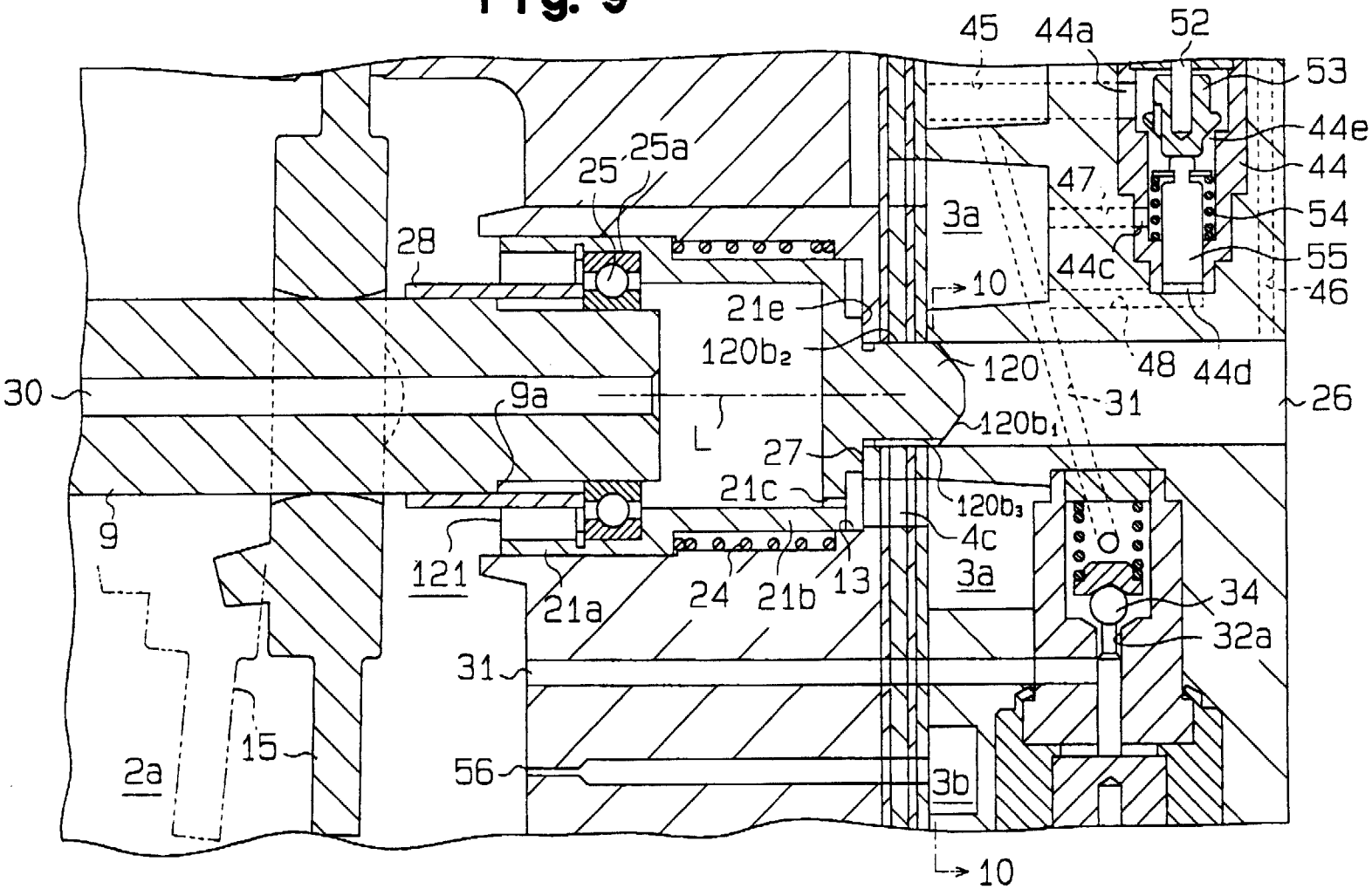
FIG. 9 is an enlarged partial cross-sectional view of the compressor of FIG. 8 when the inclined angle of a swash plate is minimum.
Figure 10:
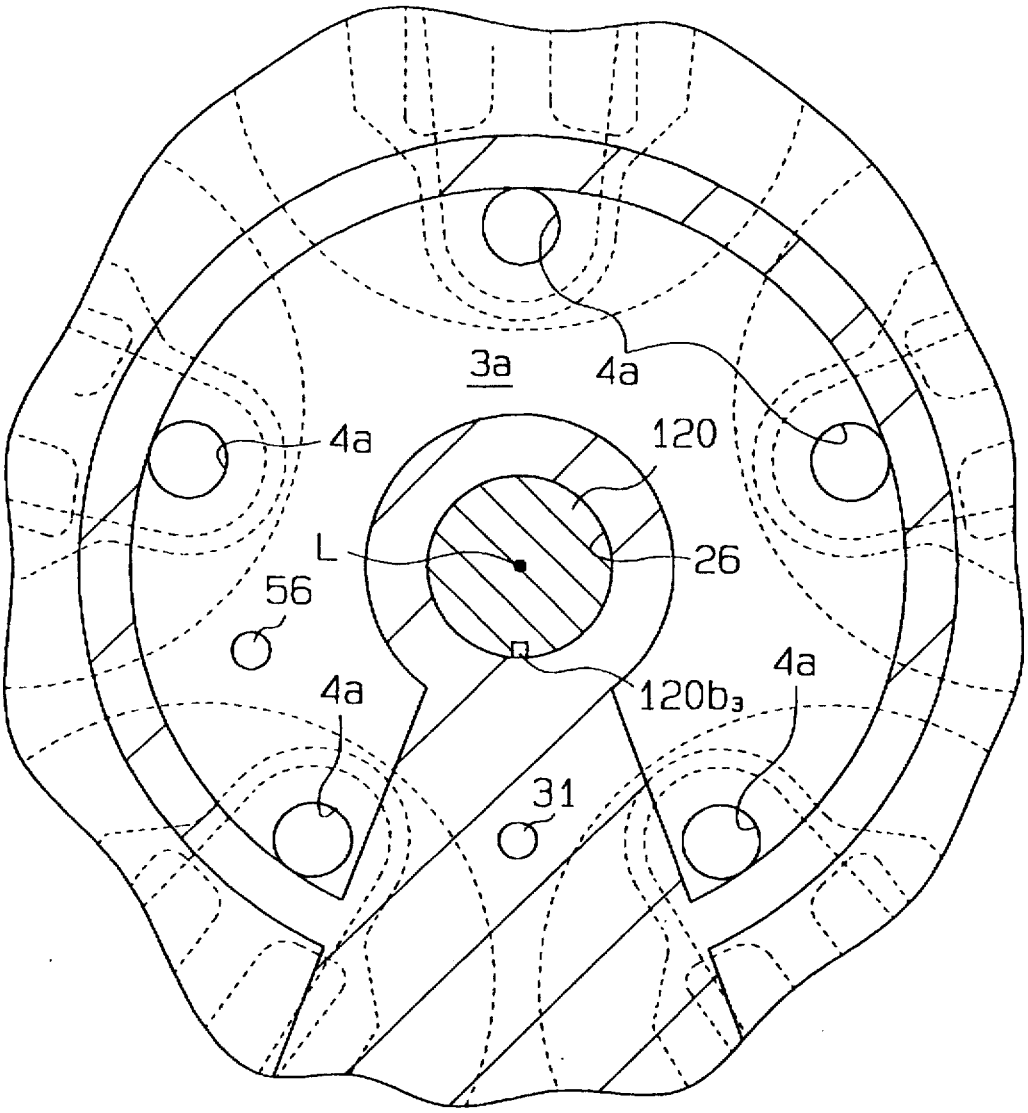
FIG. 10 is an enlarged partial cross-sectional view taken along the line 10—10 in FIG. 9.

When the suction pressure is very low and there is no cooling load on the compressor, the valve hole 44e is closed by the valve body 53 as shown in FIG. 9. When the solenoid 33 is de-excited, the passage 31 is opened. Consequently, the pressure in the crank chamber 2a rises quickly and the inclined angle of the swash plate 15 shifts toward the minimum level promptly. When the solenoid is excited in the state in FIG. 9, the passage 31 is blocked and the inclined angle of the swash plate 15 increases.

In this embodiment, the inclined angle of the swash plate 15 is controlled to change continuously as described above. The computer C controls the electromagnetic valve 32 based on the information obtained from the speed sensor 41 and the ON/OFF signal from the activation switch 40 like in the first embodiment.

A restriction or a projection 120 is integrally formed at the rear end face 21e of a shutter member 121. The restriction 120 in this embodiment, like the one in the previous embodiment, has a first surface $\mathbf{120}b_1$ and a second surface $\mathbf{120}b_2$. As shown in FIG. 10, the outside diameter of the restriction 120 is approximately the same as the inside diameter of the suction passage 26 and the restriction 120 can enter the suction passage 26. When the restriction 120 enters the suction passage 26, the second surface $\mathbf{120}b_2$ closely contacts the inner wall of the suction passage 26.

A restriction groove $\mathbf{120}b_3$ is formed in the second surface $\mathbf{120}b_2$. Before the swash plate 15 decreases its inclined angle from the midway position indicated by the broken line in FIG. 9 to the minimum level, the second surface $\mathbf{120}b_2$ enters the suction passage 26. At this time, the cross-sectional area of the open gas-passage area of the suction passage 26 is restricted to the cross-sectional area of the restriction groove $\mathbf{120}b_3$. This situation does not change until the swash plate 15 returns to the midway position indicated by the broken line in FIG. 9. Even if the inclined angle of the swash plate 15 increases, the gas-passage allowing cross-sectional area of the suction passage 26 remains constant. Therefore, the amount of refrigerant gas flowing into the suction chamber 3a from the suction passage 26 increases gradually. This causes a gradual increase in the amount of the refrigerant gas drawn into the cylinder bores 1a from the suction chamber 3a, thus gradually increasing the discharge displacement. As a result, the discharge pressure gradually increases, which prevents the load torque of the compressor from significantly changing in a short period of time. Engine stall is therefore unlikely.

Another embodiment shown in FIGS. 11 to 13 will be described below. In this embodiment, the positioning surface 27 is provided on the second plate 5A and a cylindrical restriction 220 is integrally formed at the rear end face 21e of a shutter member 221. The outside diameter of the restriction 220 is approximately the same as the inside diameter of the suction passage 26 and the restriction 220 is always located in the suction passage 26. The surface of the restriction 220 closely contacts the inner wall of the suction passage 26.

Figure 13:
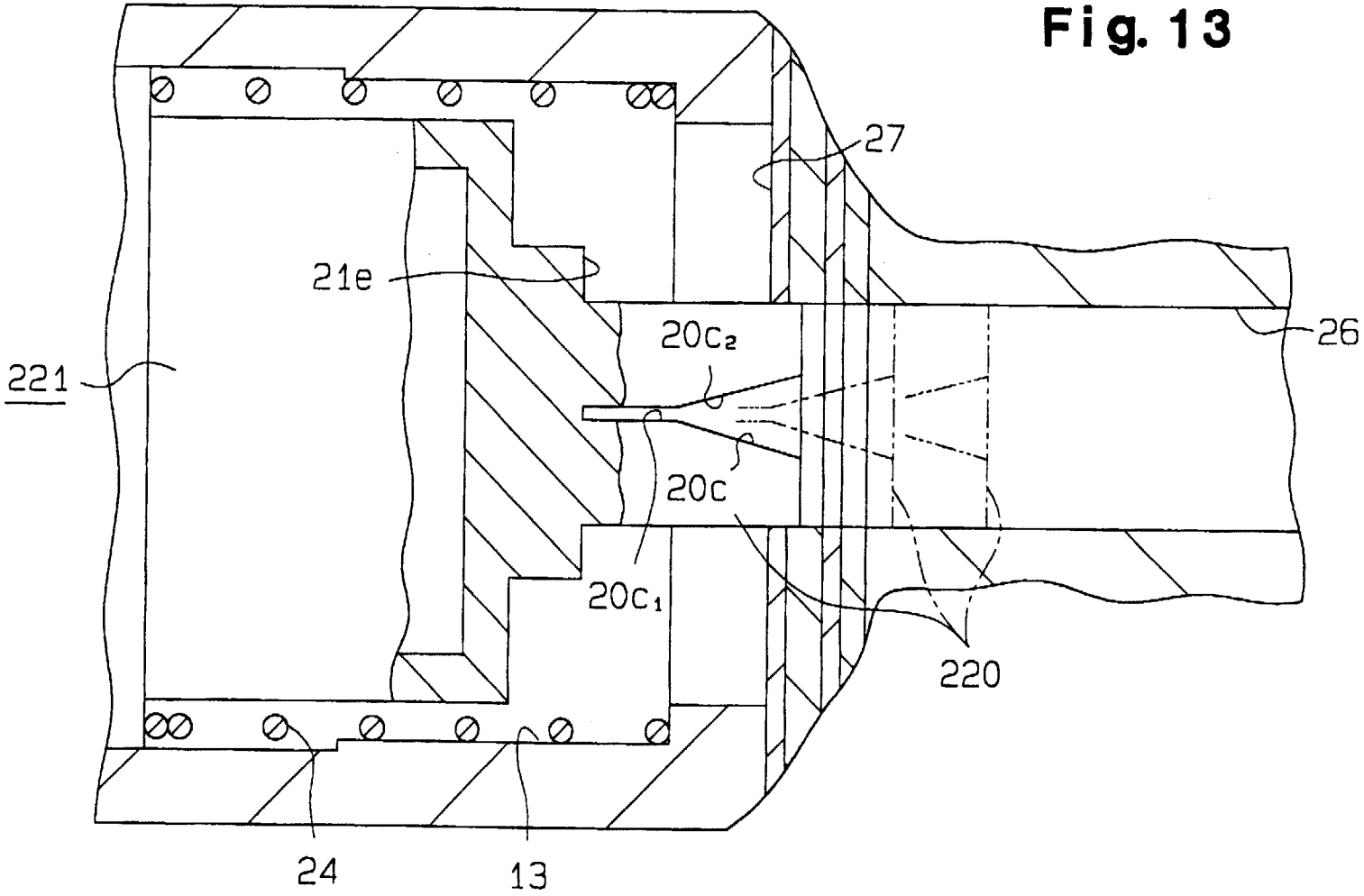
FIG. 13 is an enlarged partial cross-sectional view taken along the line 13—13 in FIG. 12.

As shown in FIG. 13, a slit 20c is formed in the surface of the restriction 220. The slit 20c has a first slit $\mathbf{20}c_1$ extending from the proximal end of the restriction 220 to the middle portion thereof with a uniform width, and a second slit $\mathbf{20}c_2$ which becomes wider toward the distal end of the restriction 220 from the middle portion.

Figure 11:
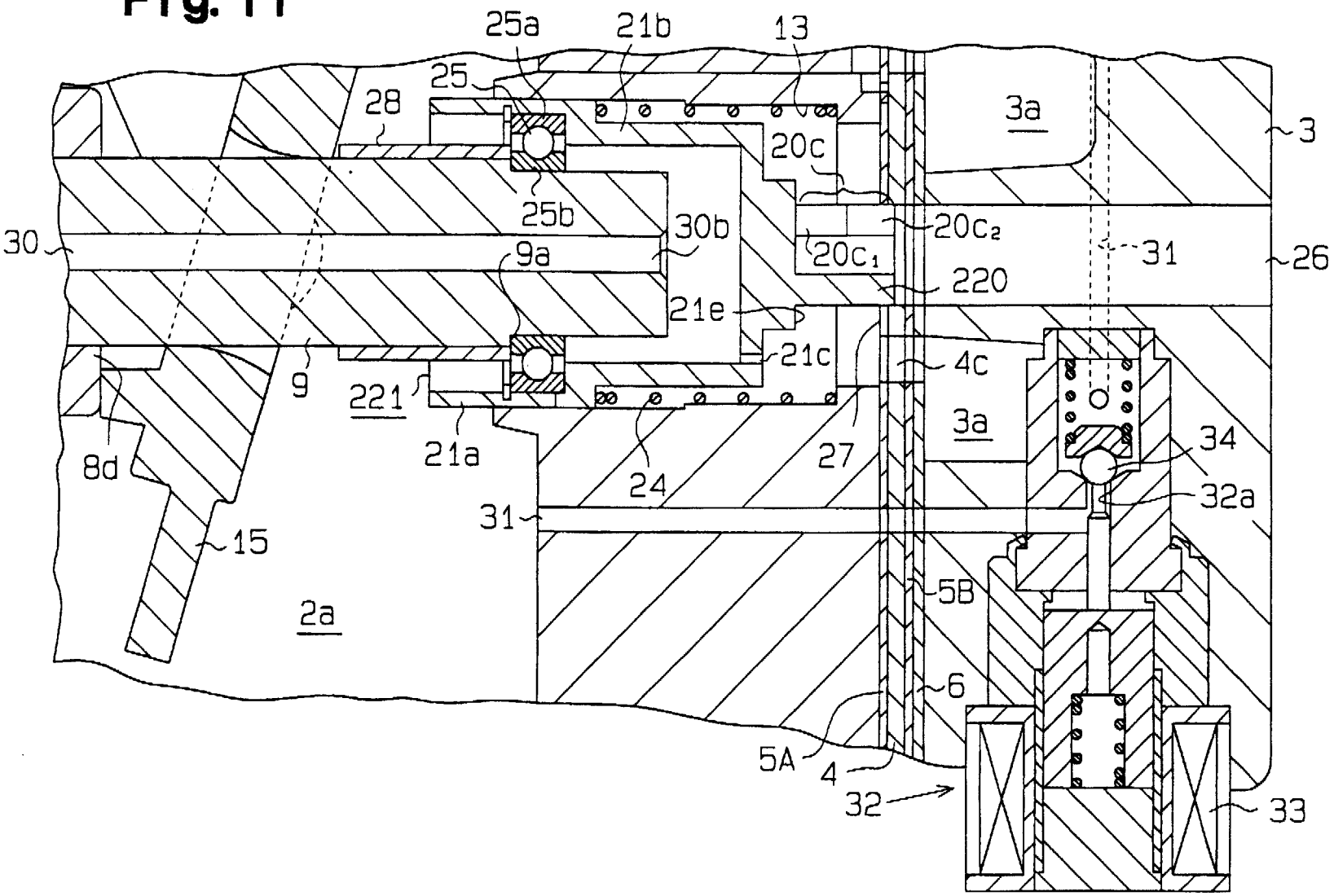
FIG. 11 is an enlarged partial cross-sectional view showing a different embodiment.

FIG. 11 shows the swash plate 15 at its maximum inclined angle. When the swash plate 15 comes to the position indicated by the broken line in FIG. 12, the inclined angle is midway between the minimum and maximum positions. When the swash plate 15 is located between the position in FIG. 11 and the position indicated by the broken line in FIG. 12, only the second slit 20c *2* enters the suction passage 26. Under this situation, the refrigerant gas from the external refrigeration circuit 35 flows into the retaining hole 13 via the second slit $\mathbf{20}c_2$ and the first slit $\mathbf{20}c_1$. When the inclined angle of the swash plate 15 changes between its maximum value and its intermediate value, the cross-sectional area of the gas passage between the suction passage 26 and the retaining hole 13 becomes the sum of the cross-sectional area of the first slit $\mathbf{20}c_1$ positioned in the retaining hole 13 and the cross-sectional area of a part of the second slit $\mathbf{20}c_2$.

Figure 12:
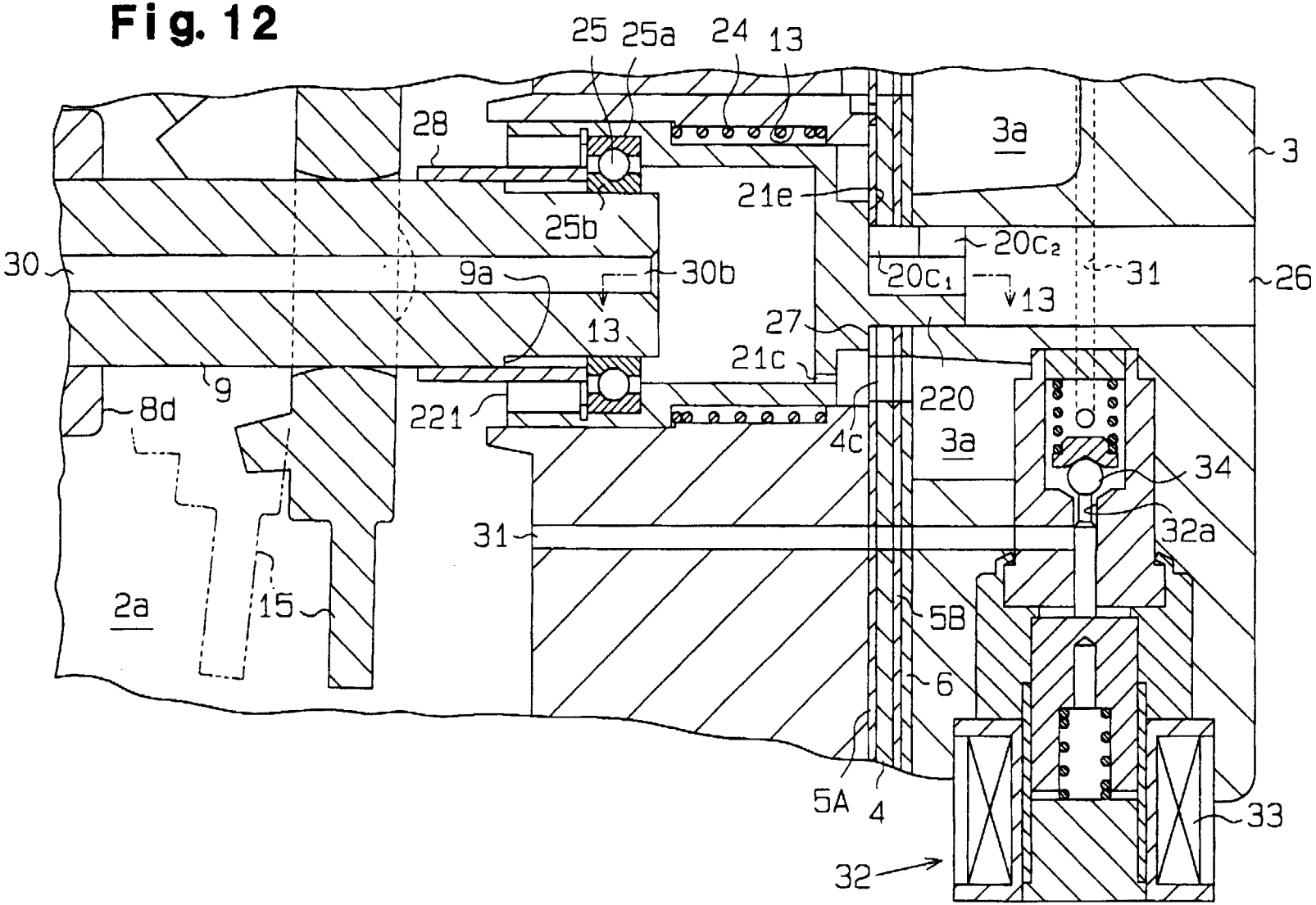
FIG. 12 is an enlarged partial cross-sectional view of the compressor of FIG. 11 when the inclined angle of a swash plate is minimum.

When the swash plate 15 is located between the intermediate position indicated by the broken line in FIG. 12 and the position of the minimum angle, the first slit $\mathbf{20}c_1$ is positioned in the suction passage 26. The cross-sectional area of the passage for the refrigerant gas between the suction passage 26 and the retaining hole 13 is limited to that of a part of the first slit $\mathbf{20}c_1$ positioned in the retaining hole 13. This cross-sectional area gradually increases until the swash plate 15 reaches the intermediate position indicated by the broken line in FIG. 12. Therefore, the amount of refrigerant gas flowing into the suction chamber 3*a* from the suction passage 26 increases gradually. This causes gradual increases in the amount of refrigerant gas drawn into the cylinder bores 1*a* from the suction chamber 3*a* and in the discharge displacement. As a result, the discharge pressure increases gradually, which prevents the load of the compressor from significantly changing in a short period of time. Therefore, the engine stall is most unlikely to occur.

In this embodiment, the restriction of the suction passage 26 can be set as desired by properly setting the width of the slit 20*c*, so that the amount of gas flowing into the cylinder bores 1*a* from the suction passage 26 can be controlled properly.

Figure 14:
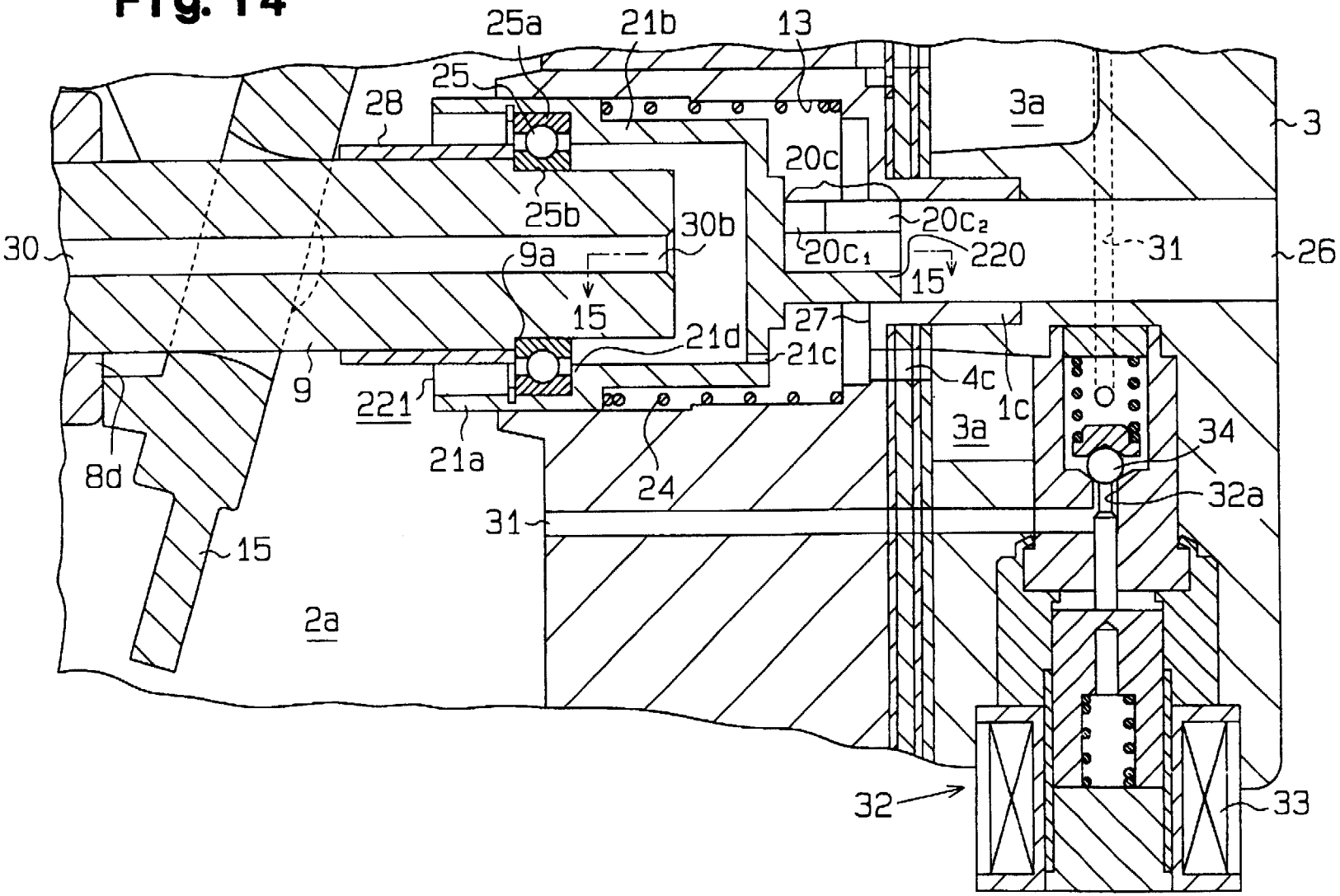
FIG. 14 is an enlarged partial cross-sectional view showing a further embodiment.
Figure 15:
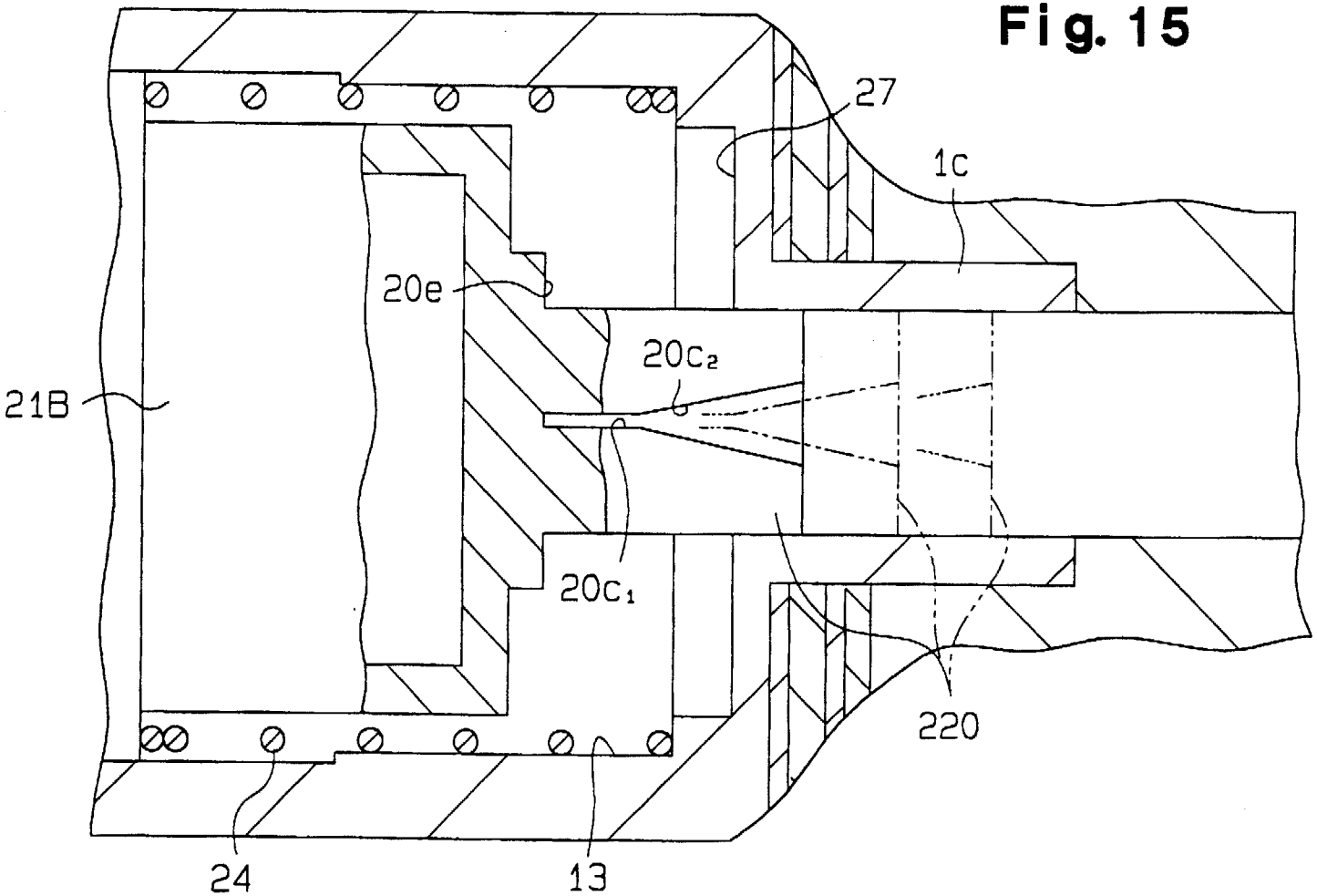
FIG. 15 is an enlarged partial cross-sectional view taken along the line 15—15 in FIG. 14.

An embodiment shown in FIGS. 14 and 15 will be discussed below. In this embodiment, a shutter member 221 and the restriction 220, which have the same structures as those of the embodiment illustrated in FIGS. 11 through 13, are used and a part of the cylinder block 1 is used as a part of the suction passage 26. More specifically, a cylindrical passage former 1*c* is attached to the cylinder block 1. The passage former 1*c* is located in the suction passage 26 so that the internal portion of the passage former 1*c* constitutes a part of the suction passage 26. The restriction 220 is always located in the passage former 1*c*. When the inclined angle of the swash plate 15 increases from the minimum value, the cross-sectional area of the passage between the suction passage 26 and the retaining hole 13 gradually increases due to the action of the restriction 220 as in the embodiment shown in FIGS. 11 to 13. Therefore, the load torque of the compressor does not change significantly in a short period of time and engine stall is unlikely.

The provision of the passage former 1*c* in the cylinder block 1 allows the positional relation between the retaining hole 13 and the suction passage 26 to be set accurately. It is thus possible to easily manage the clearance between the outer surface of the restriction 220 and the inner wall of the passage former 1*c*. This facilitates the restriction control in the suction passage 26.

Figure 16:
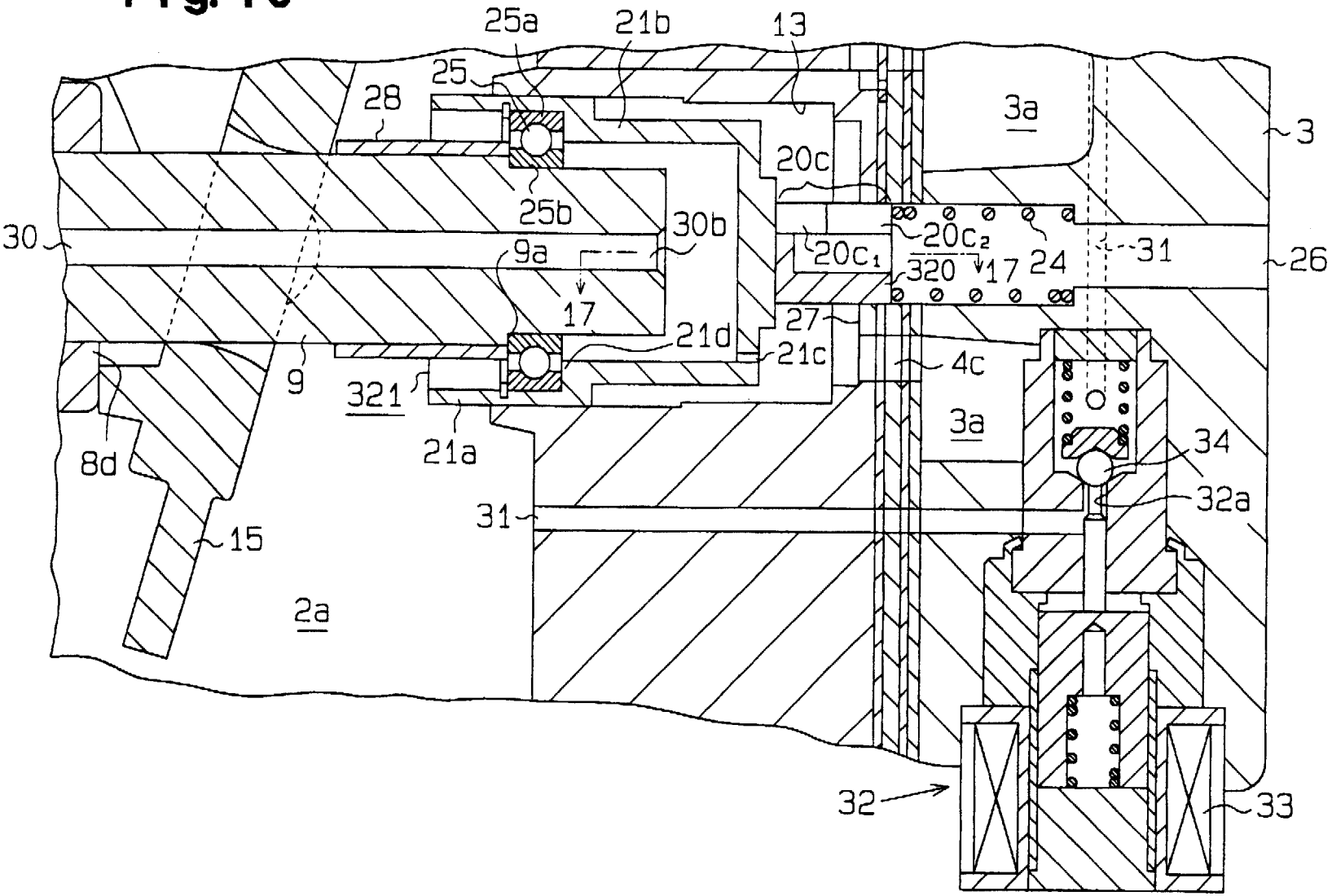
FIG. 16 is an enlarged partial cross-sectional view showing a still further embodiment.
Figure 17:
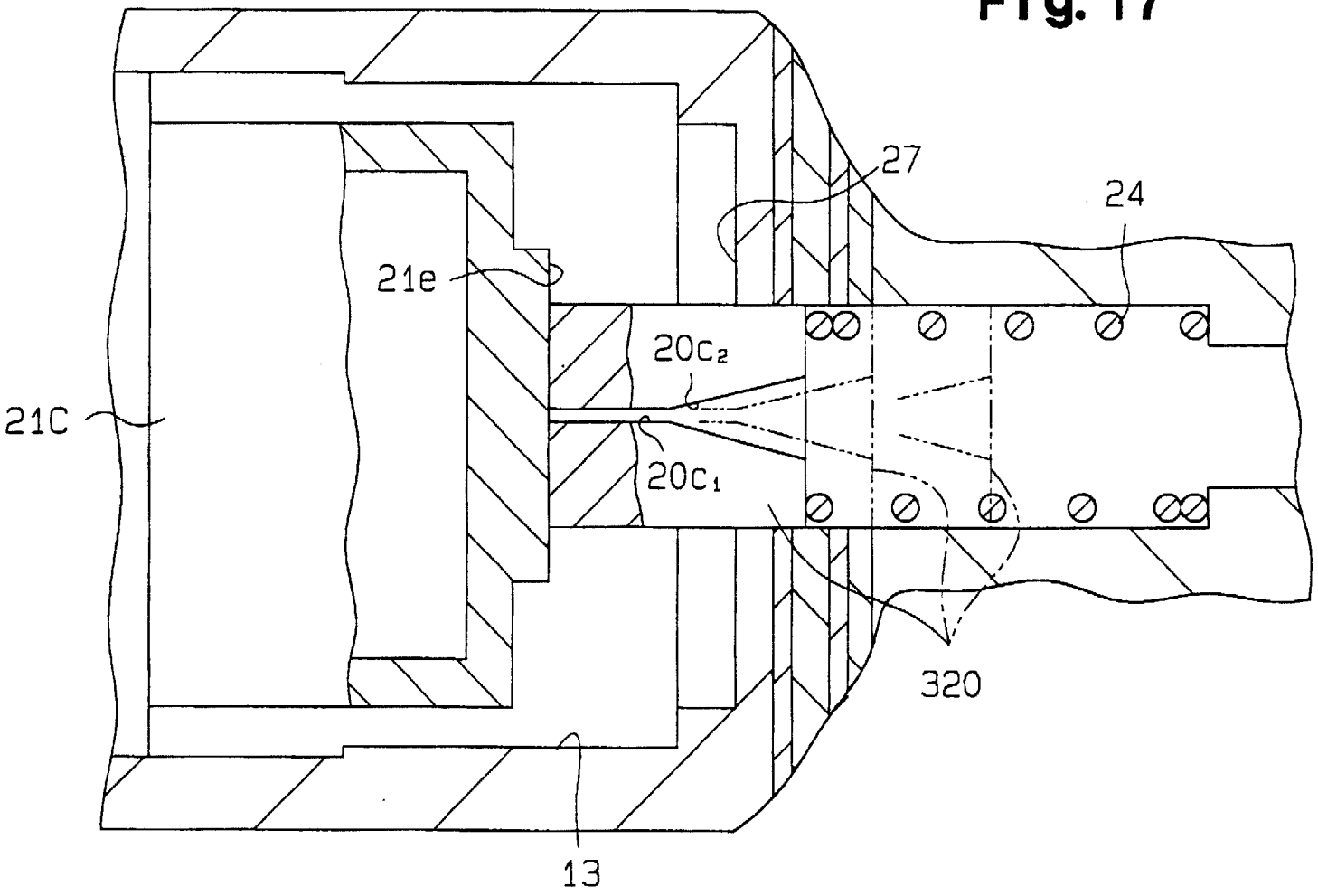
FIG. 17 is an enlarged partial cross-sectional view taken along the line 17—17 in FIG. 16.

An embodiment shown in FIGS. 16 and 17 will be discussed below. In this embodiment, a shutter member 321 and a cylindrical restriction 320 are formed separately and the restriction 320 is always located in the suction passage 26. The restriction 320 is always pressed against the rear end face 21*e* of the shutter member 321 by the urging force of the spring 24 in the suction passage 26. The restriction 320 is formed with a slit 20*c* similar to the one shown in FIGS. 11 to 13. In this embodiment too, when the inclined angle of the swash plate 15 increases from the minimum value, the cross-sectional area of the passage between the suction passage 26 and the retaining hole 13 and eventually the cross-sectional area of the passage between the suction passage 26 and the suction chamber 3*a* gradually increase due to the action of the restriction 320. Therefore, the load of the compressor does not change significantly in a short period of time and the possibility of the engine stalling is reduced.

Figure 18:
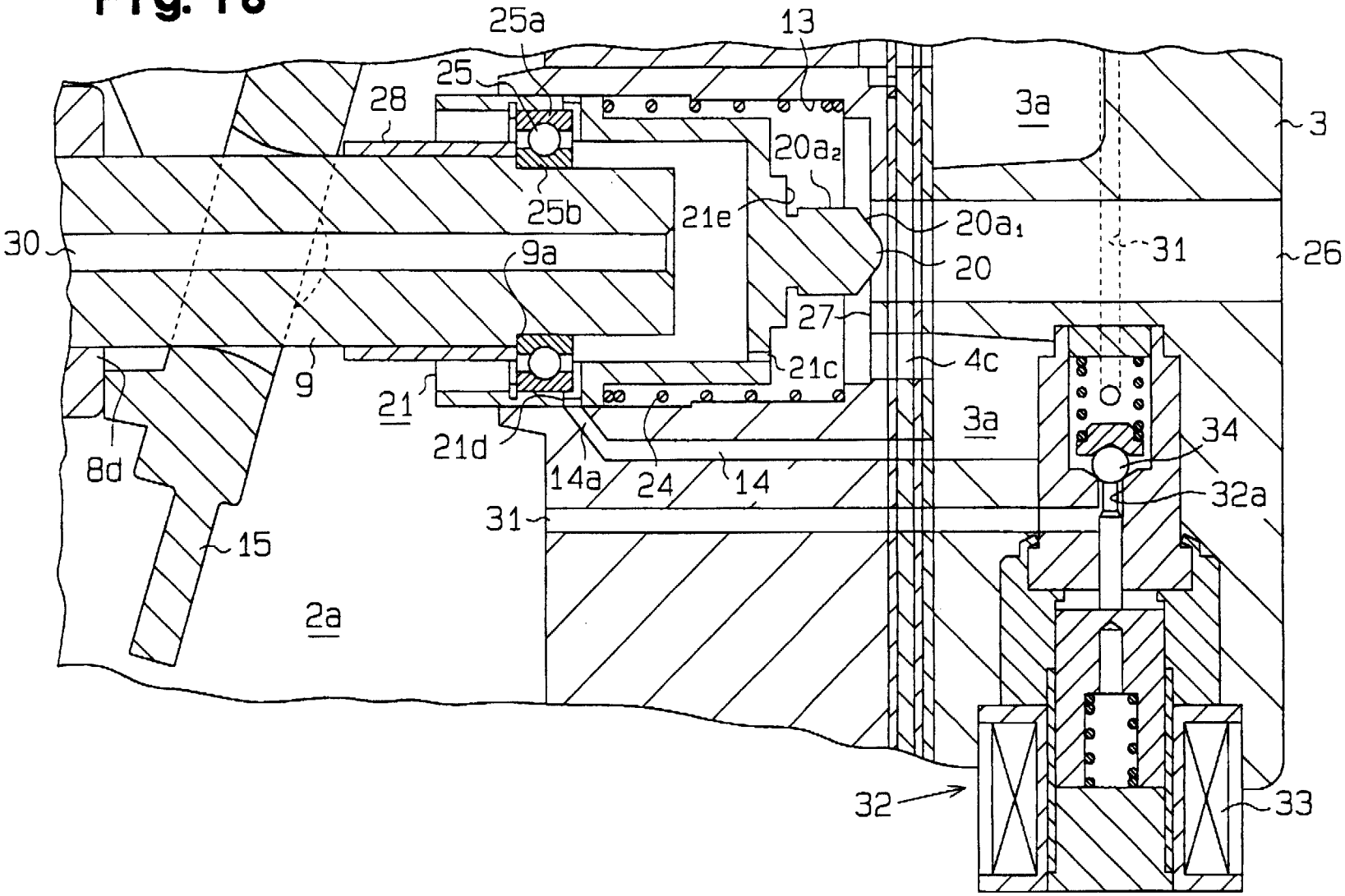
FIG. 18 is an enlarged partial cross-sectional view showing a yet still further embodiment.

An embodiment shown in FIGS. 18 and 19 will be discussed below. In this embodiment, the connection passage 21*d* is formed in the surface of the large diameter portion 21*a* of the shutter member 21. A passage 14 is formed in the cylinder block 1. The passage 14 has an inlet 14*a* open to the inner wall of the retaining hole 13, and an outlet open to the suction chamber 3*a*. When the incline of the swash plate 15 is maximized as shown in FIG. 18, the connection passage 21*d* on the shutter member 21 is connected to the inlet 14*a* of the passage 14. When the swash plate 15 is located between the intermediate position indicated by a broken line in FIG. 19 and the position where the incline becomes minimized, the connection passage 21*d* is disconnected from the inlet 14*a*.

When the incline of the swash plate 15 is maximized as shown in FIG. 18, the pressure release hole 21*c* connects the retaining hole 13 to the interior of the shutter member 21. When the incline of the swash plate 15 is at its minimum as shown in FIG. 19, the pressure release hole 21*c* connects the interior of the shutter member 21 to the communication hole 4*c*. Therefore, the pressure release hole 21*c* always connects the crank chamber 2*a* to the suction chamber 3*a*.

When the incline of the swash plate 15 is near its maximum value, the crank chamber 2*a* communicates with the suction chamber 3*a* via the pressure release hole 21*c*, and communicates with the suction chamber 3*a* via the connection passage 21*a* and the inlet 14*a*. When the swash plate 15 is positioned between the intermediate position indicated by the broken line in FIG. 19 and the position of the minimum incline, the crank chamber 2*a* communicates with the suction chamber 3*a* only via the pressure release hole 21*c*. Accordingly, the cross-sectional area of the pressure release passage which connects the crank chamber 2*a* to the suction chamber 3*a* changes in accordance with the incline of the swash plate 15.

The cross-sectional area $S_3$ of the pressure release hole 21*c* is smaller than the cross-sectional area $S_4$ of the inlet 14*a* of the passage 14. The cross-sectional area $S_4$ is smaller than the cross-sectional area of the passage 30. The cross-sectional area $S_3+S_4$ is set to stably hold the swash plate 15 at its maximum inclined angle. The cross-sectional area $S_3$ is set so as to stably hold the swash plate 15 at its minimum inclined angle when the passage 31 is open.

Figure 19:
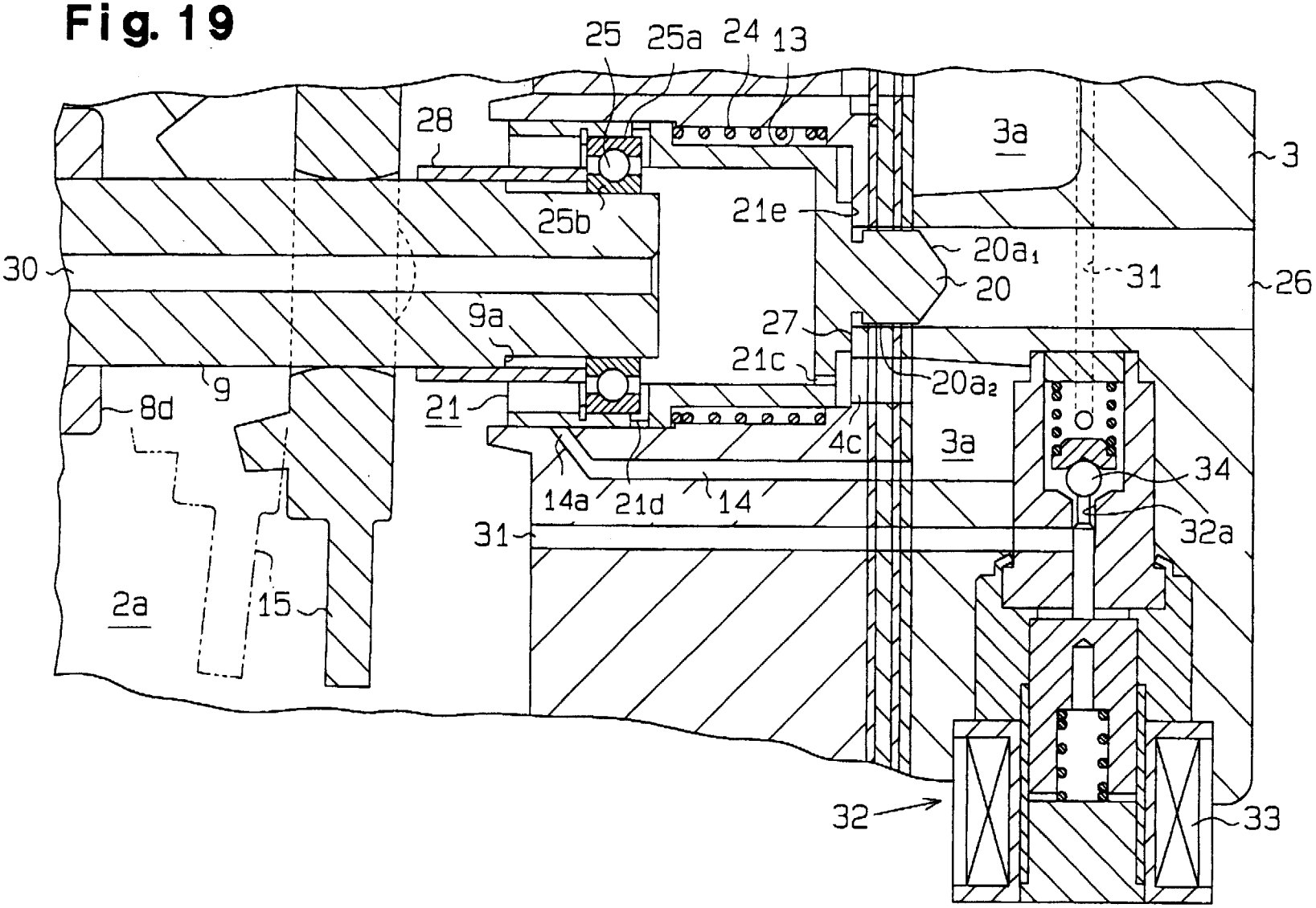
FIG. 19 is an enlarged partial cross-sectional view of the compressor of FIG. 18 when the inclined angle of a swash plate is minimum.

While the swash plate 15 moves to the intermediate position indicated by the broken line in FIG. 19 from the position of its minimum incline, the connection passage 21*d* on the shutter member 21 is not connected to the inlet 14*a* of the passage 14. In this state, the cross-sectional area of the pressure release passage from the crank chamber 2*a* to the suction chamber 3*a* is restricted by the cross-sectional area $S_3$ of the pressure release hole 21*c*. When the refrigerant gas is discharged to the suction chamber 3*a* from the crank chamber 2*a*, therefore, the gas is restricted by the pressure release hole 21*c* and the pressure reduction in the crank chamber 2*a* is performed gradually. The time for the swash plate 15 to move to the position of the maximum incline from the position of the minimum incline depends on the size of the cross-sectional area $S_3$ of the pressure release hole 21*c*.

When the incline of the swash plate 15 lies between the maximum angle and the minimum angle, the cross-sectional area of the pressure release passage extending from the crank chamber 2*a* to the suction chamber 3*a* ($S_3$) is set smaller than the cross-sectional area $S_3+S_4$ for stably holding the swash plate 15 at the maximum incline. It is therefore possible to slowly increase the incline of the swash plate 15 from its minimum value. This gentle increase in the incline and the restricting action of the restriction 20 ensure a gradual increase in the load torque of the compressor when the swash plate moves to the position of maximum incline from the position of minimum incline. This allows the feedback control by the ISC 42 to follow up a change in engine speed, so that engine stalling becomes less likely.

Figure 20:
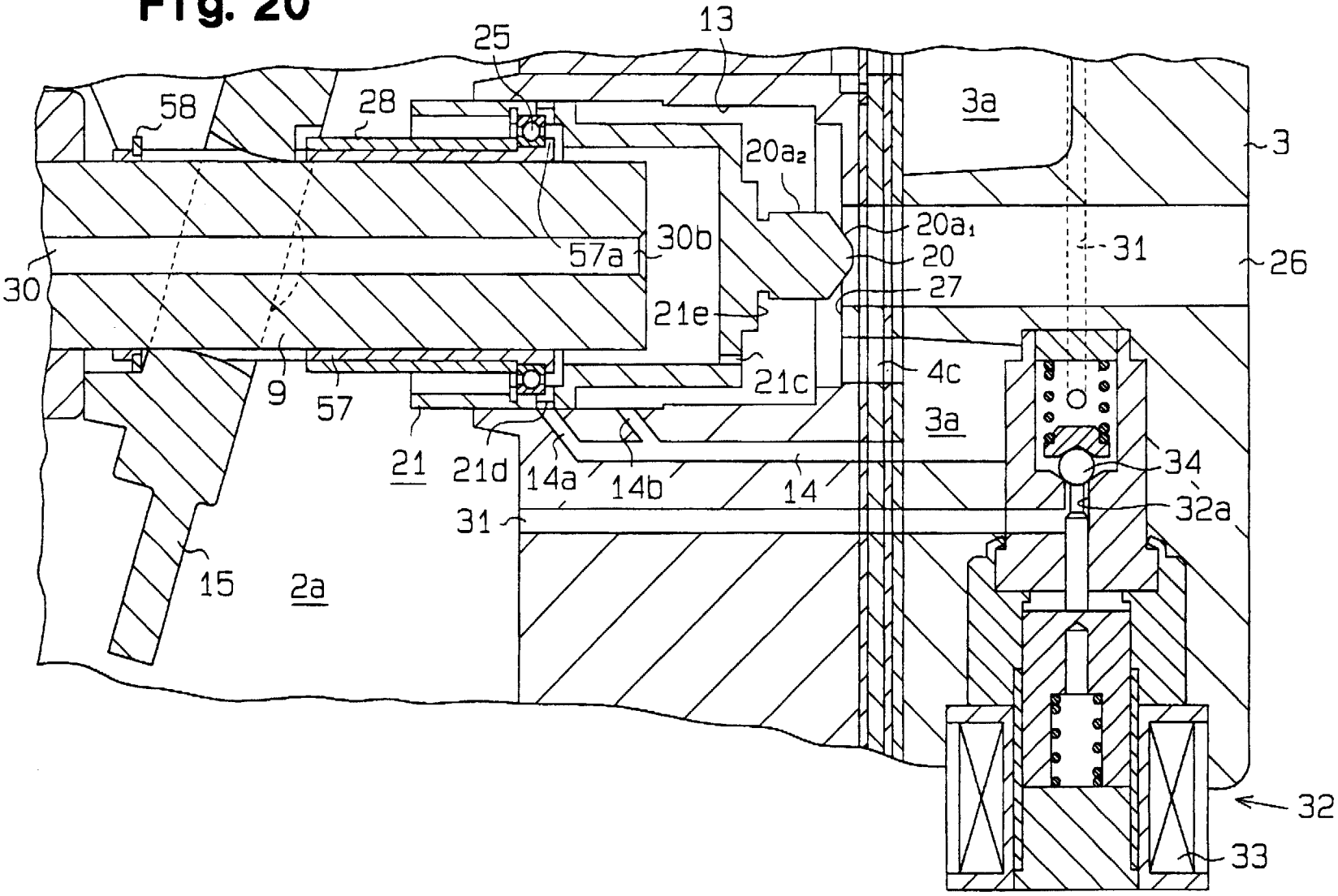
FIG. 20 is an enlarged partial cross-sectional view of a yet still further embodiment.
Figure 21:
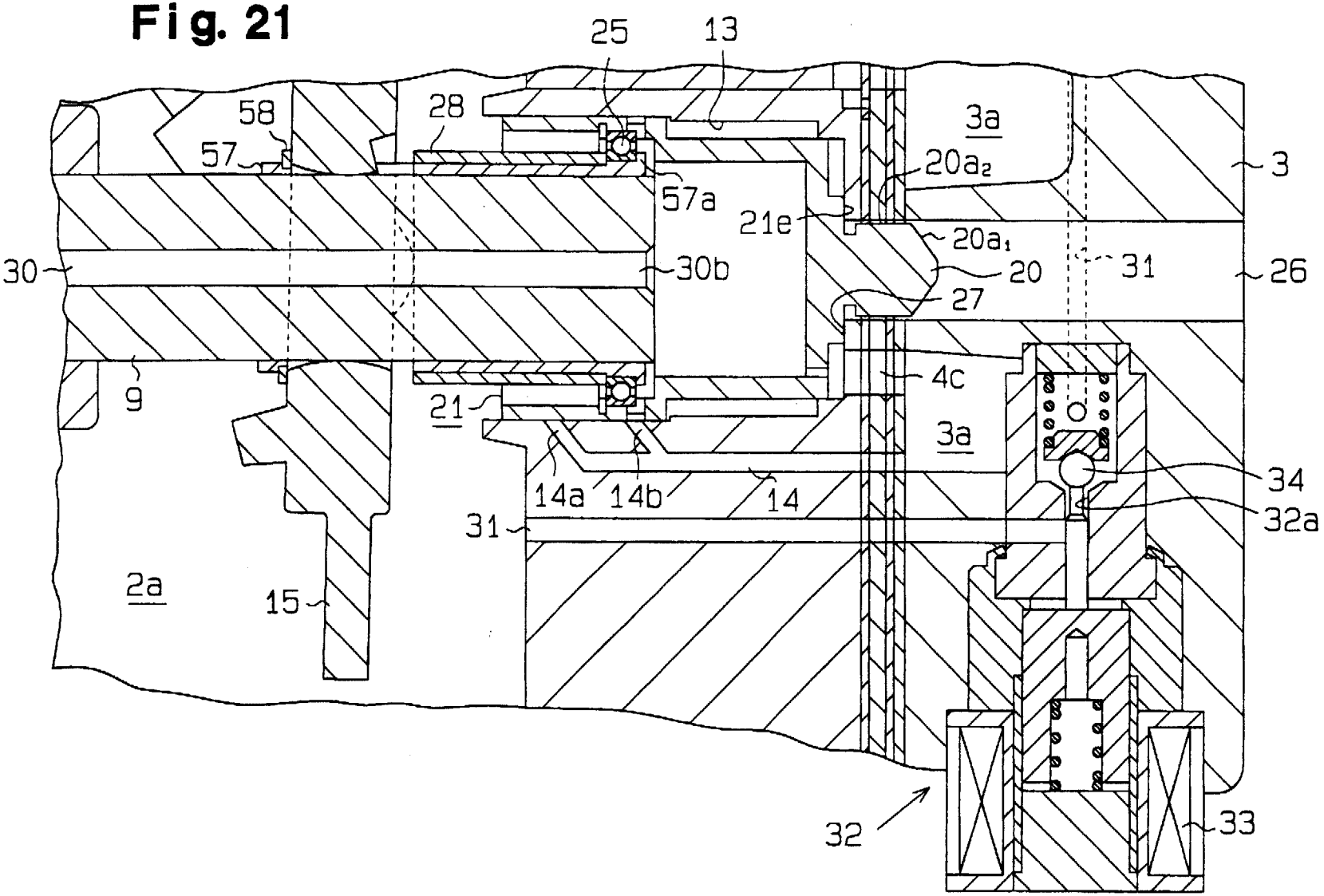
FIG. 21 is an enlarged partial cross-sectional view of the compressor of FIG. 20 when the inclined angle of a swash plate is minimum.

An embodiment shown in FIGS. 20 and 21 will be discussed below. In this embodiment, a connection pipe 57 is slidably supported on the rotary shaft 9. A circlip 58 is interposed between the front end of the connection pipe 57 and the swash plate 15. A flange portion 57*a* provided at the rear end of the connection pipe 57 is engaged with the inner race 25*b* of the ball bearing 25. The transmission pipe 28 is supported on the pipe 57. The pipe 28 always abuts on both the swash plate 15 and the inner race 25*b*. The shutter member 21 is therefore coupled via the connection pipe 57 and the pipe 28 to the swash plate 15 in such a way as to respond to the inclination of the swash plate 15. This eliminates the need for the spring 24 in the above-described embodiments.

A first inlet 14*a* and a second inlet 14*b* are formed in the passage 14 in the cylinder block 1. When the swash plate 15 is in the vicinity of the position of the maximum inclination as shown in FIG. 20, the connection passage 21*d* is connected to the first inlet 14*a*. When the swash plate 15 is in the vicinity of the position of the minimum inclination as shown in FIG. 21, the connection passage 21*d* is connected to the second inlet 14*b*, as shown in FIG. 21. When the swash plate 15 is midway between the position of the minimum inclination and the position of the maximum inclination, the cross-sectional area of the pressure release passage becomes equal to that of the pressure release hole 21*c*. It is therefore possible to slowly increase the incline of the swash plate 15 from its minimum value. This gentle increase in the inclined angle and the restricting action of the restriction 20 ensure a gentle increase in the load torque of the compressor when the swash plate moves to the position of the maximum incline from the position of the minimum incline. Therefore, stalling of the engine is most unlikely. The cross-sectional area of the pressure release passage when the swash plate is at the minimum incline is the same as that when the swash plate is at the maximum incline. As a result, the amount of oil circulating in the compressor is greater than that in the embodiment shown in FIGS. 18 and 19, and the lubrication is improved accordingly.

An embodiment shown in FIGS. 22 and 23 will be discussed below. In this embodiment, the positioning surface 27 is provided on the second plate 5A and a restriction 420 is integrally formed at the rear end face 21*e* of a shutter member 421. The surface $\mathbf{20}d_0$ of the restriction 420 has a tapered first surface $\mathbf{20}d_1$ at the distal end and a tapered second surface $\mathbf{20}d_2$ at the proximal end. The first surface $\mathbf{20}d_1$ and second surface $\mathbf{20}d_2$ are formed around the axis L of the rotary shaft 9. The inclination of the second surface $\mathbf{20}d_2$ is smaller than the inclination of the first surface $\mathbf{20}d_1$.

Figure 22:
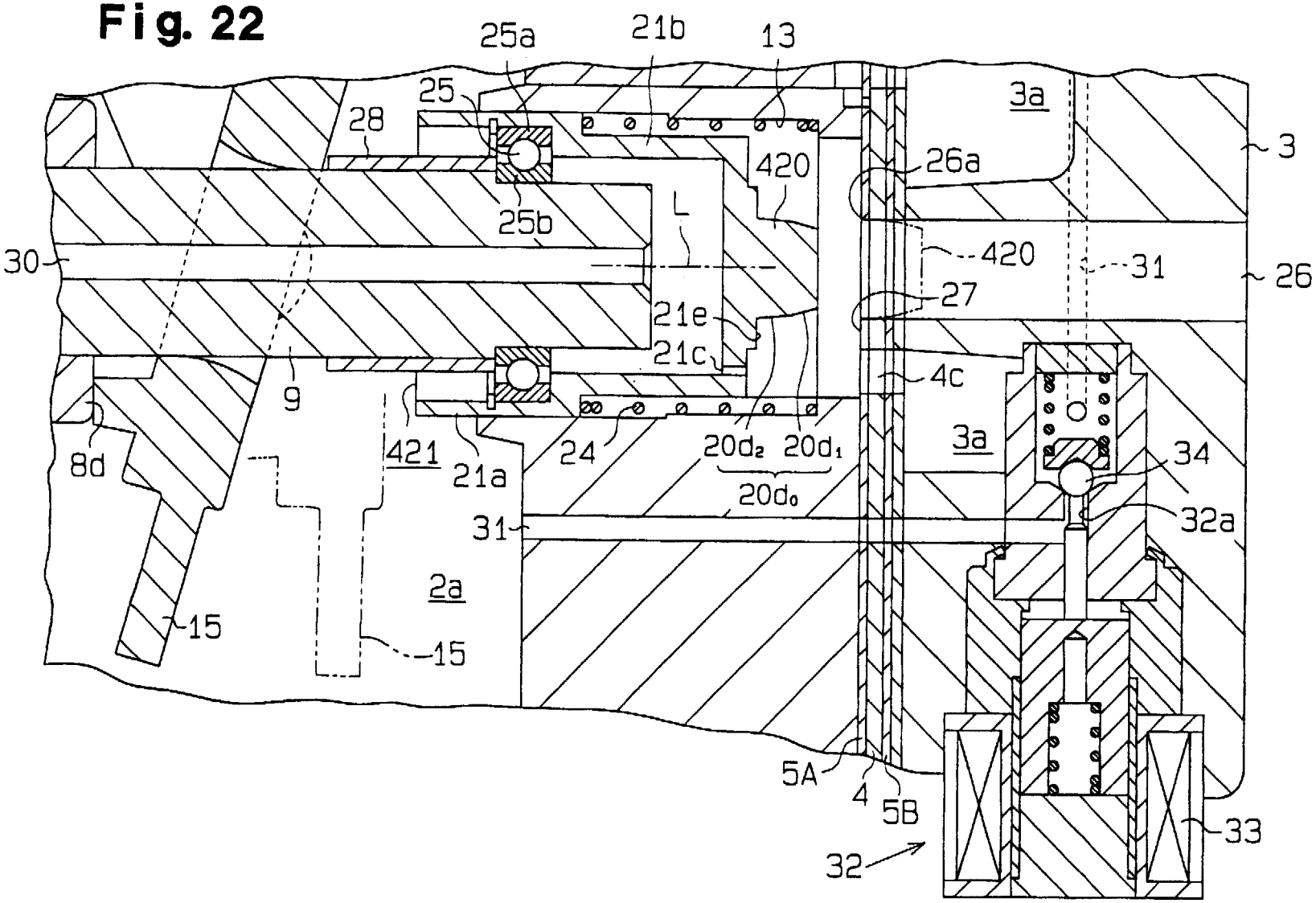
FIG. 22 is an enlarged partial cross-sectional view showing yet another embodiment.

The outside diameter of the restriction 420 at the proximal end is set slightly smaller than the inside diameter of the suction passage 26, and the restriction 420 can entirely be positioned in the suction passage 26, as indicated by a broken line in FIG. 22. When the restriction 420 enters the suction passage 26 completely, the rear end face 21*e* abuts on the positioning surface 27 to close the suction passage 26.

Figure 23:
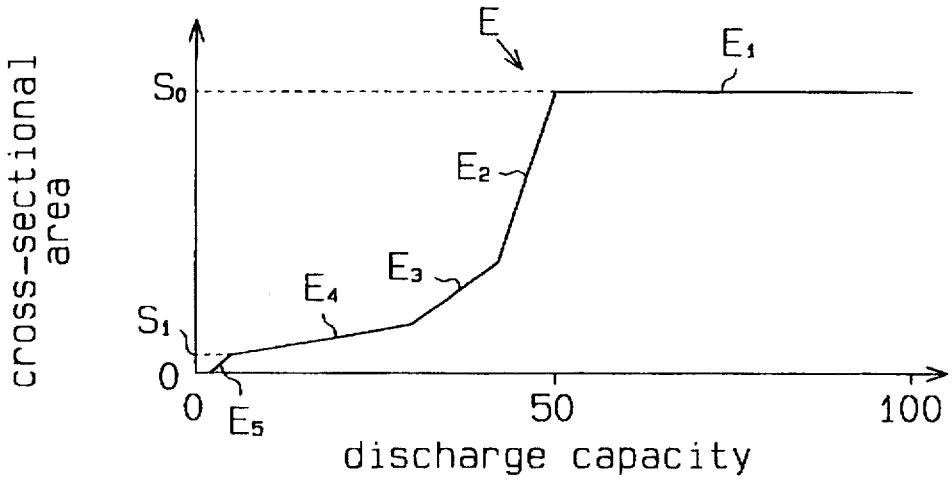
FIG. 23 is a graph showing a change in the cross-sectional area of a suction passage.

A curve E of the graph in FIG. 23 represents a change in the cross-sectional area of the suction passage 26 over the entire range where the incline of the swash plate changes to the minimum from the maximum, i.e., where the discharge displacement changes to the maximum from the minimum. A horizontal line E1 represents the cross-sectional area $S_0$ of the outlet 26*a* of the suction passage 26 when the restriction 420 is located at the position shown in FIG. 22; that is, when it is completely apart from the suction passage 26.

A straight line E2 represents a change in the cross-sectional area of the passage while the restriction 420 moves from the position shown in FIG. 22 to the vicinity of the outlet 26*a* of the suction passage 26. A straight line E3 represents the cross-sectional area of the passage until most of the first surface $\mathbf{20}d_1$ enters the suction passage 26. A straight line E4 represents a change in the cross-sectional area of the passage until most of the second surface $\mathbf{20}d_2$ is positioned in the suction passage 26. The cross-sectional area of the passage when the second surface $\mathbf{20}d_2$ enters the suction passage 26 is represented by S1. A straight line E5 represents a change in the cross-sectional area of the passage until the shuttering face 21*e* abuts on the outlet 26*a*.

The inclination of the second surface $\mathbf{20}d_2$ is gentler than the inclination of the first surface $\mathbf{20}d_1$, so that the ratio of the change of the cross-sectional area in the suction passage 26 caused by the restricting action of the second surface $\mathbf{20}d_2$ (E4) is gentler than the change ratio E3 associated with the first surface $\mathbf{20}d_1$. The provision of the two surfaces $\mathbf{20}d_1$ and $\mathbf{20}d_2$ of different inclinations allows the cross-sectional area of the passage 26 to change much more gently, particularly when the discharge displacement is small. Therefore, the incline of the swash plate increases more gradually and the load torque of the compressor increases more slowly as compared with the previous embodiments. It is thus less likely that the engine will stall in this embodiment than in the previous embodiments.

The outside diameter of the restriction may be changed in multisteps or continuously. From the viewpoint of easy working, it is optimal that the surface of the restriction is made of two surfaces $\mathbf{20}d_1$ and $\mathbf{20}d_2$ having different inclinations as in this embodiment.

When the inclined angle of the swash plate is large, the open gas-passage area in the suction passage 26 is maximized as indicated by the straight line E1. If the suction passage 26 is restricted at this time, the suction resistance increases so that the volumetric efficiency may drop. When the inclined angle of the swash plate is large as in this embodiment, therefore, the open gas-passage area in the suction passage 26 should not be restricted.

Figure 24:
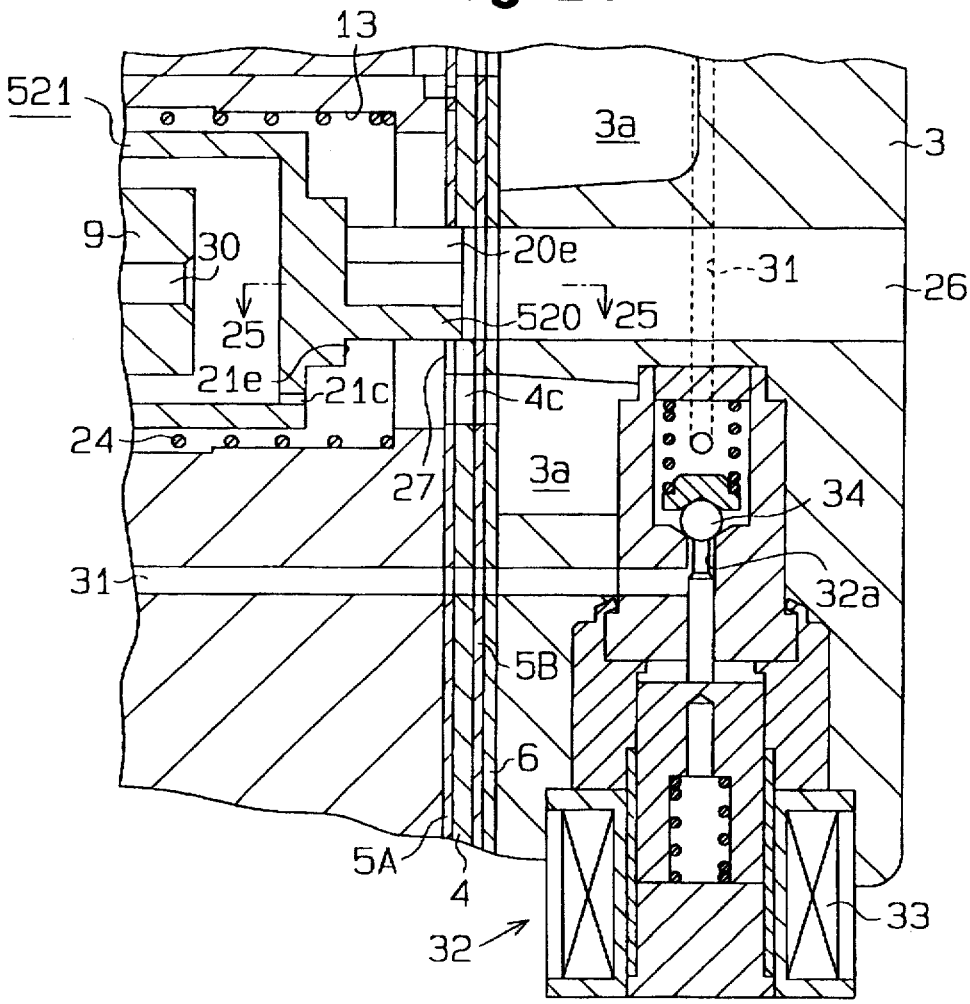
FIG. 24 is an enlarged partial cross-sectional view showing yet another embodiment.

An embodiment shown in FIGS. 24 and 25 will be discussed below. In this embodiment, a cylindrical restriction 520 is integrally formed at the rear end face 21*e* of a shutter member 521. The outside diameter of the restriction 520 is approximately the same as the inside diameter of the suction passage 26. A part of the restriction 520 is always positioned inside the suction passage 26. The outer surface of the restriction 520 closely contacts the inner wall of the suction passage 26 and there is no clearance between them.

Figure 25:
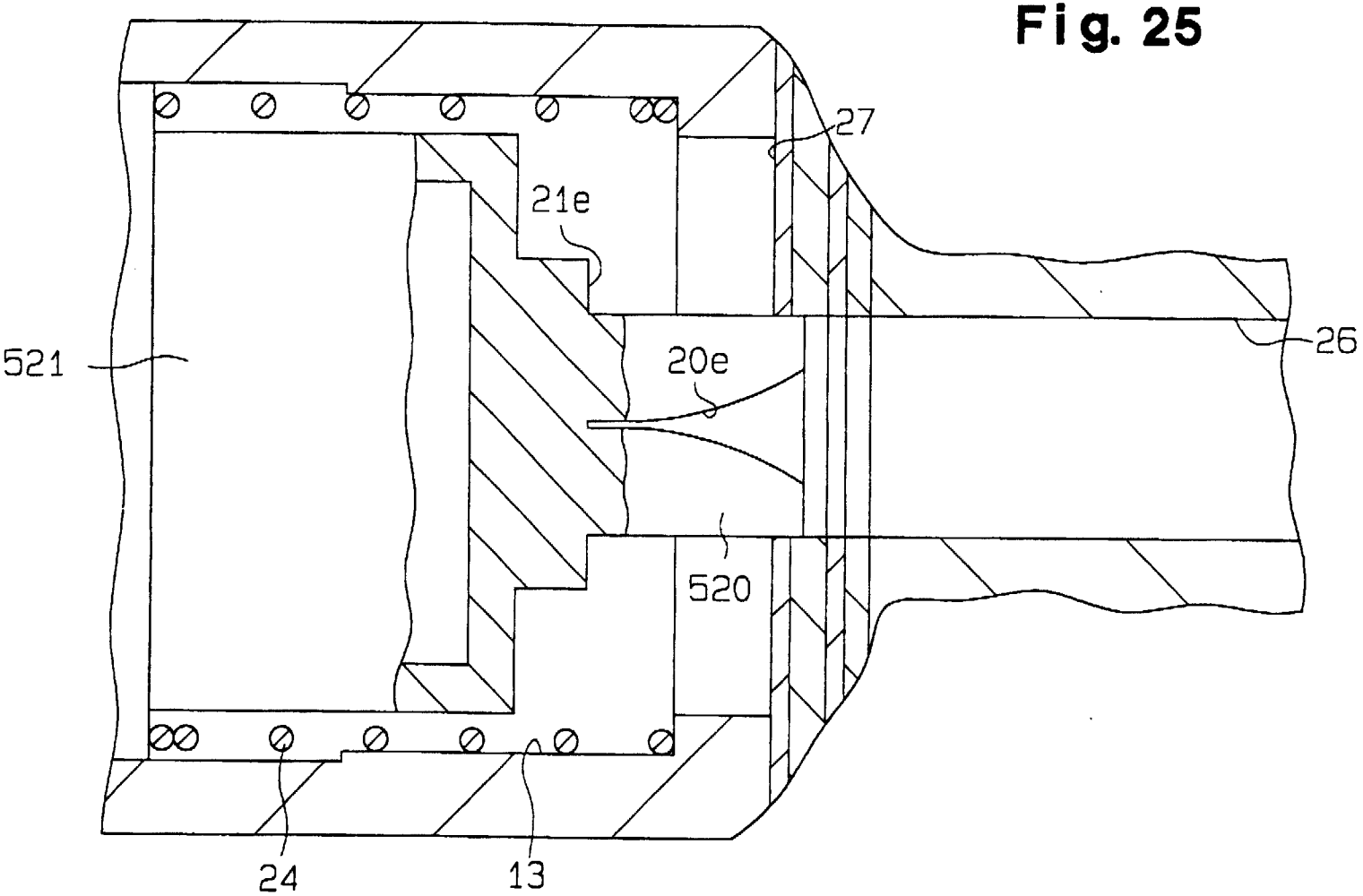
FIG. 25 is an enlarged partial cross-sectional view taken along the line 25—25 in FIG. 24.

As shown in FIG. 25, a hornlike slit 20*e* is formed in the surface of the restriction 520. The structure of this embodiment is the same as that of the embodiment illustrated in FIGS. 11 to 13 except for the difference in the shape of the slit 20*c*. The slit 20*e* gradually spreads toward the distal end of the restriction 520 from the proximal end. The shape of the slit 20*e* is set in such a manner that a change in the gas-passage allowing area in the passage 26 is approximated by the change represented by the curve E in FIG. 23. Therefore, an increase in the load torque of the compressor is also relaxed in this embodiment as in the embodiment shown in FIG. 22.

The restriction 520 of this embodiment may be replaced with the restriction 20 of the compressor which has restriction passage 56 and the displacement control valve 43 of FIG. 8.

The suction pressure area, other than the suction chamber 3a, includes the interior of the retaining hole 13 and communication hole 4c, disconnected from the crank chamber 2a by the shutter member in each of the above-described embodiments.

The discharge pressure area, other than the discharge chamber 3b, includes the interior of the outlet port 1b and the external refrigeration circuit between the discharge outlet 1b and the evaporator 36.

Figure 28:
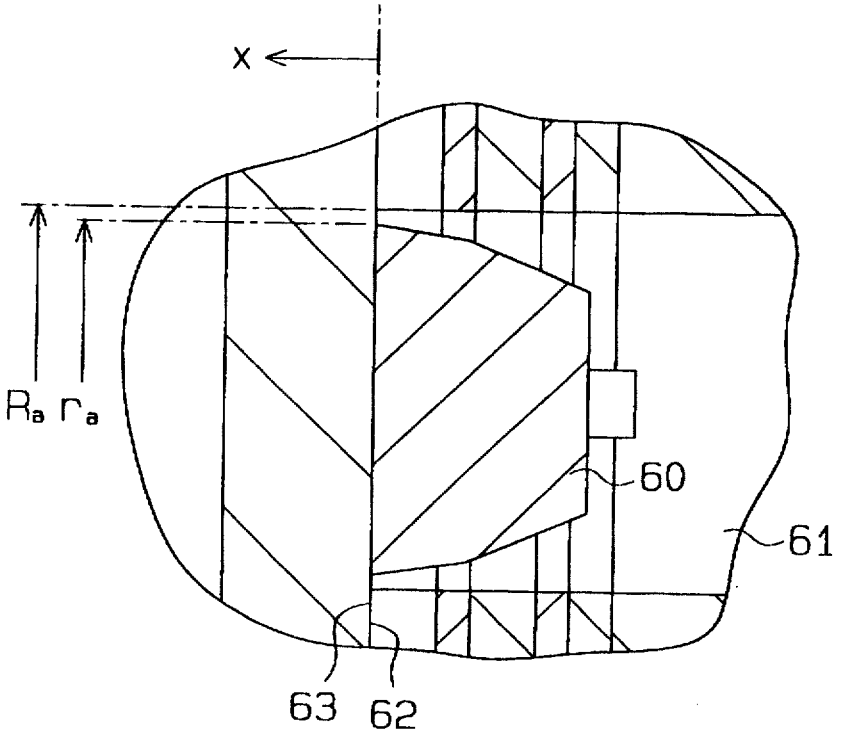
FIG. 28 is an enlarged partial cross-sectional view of a comparative example compressor for the embodiment shown in FIG. 26.

An embodiment shown in FIGS. 26(*a*) and 26(*b*) will be discussed below. The compressor shown in FIG. 28 is a comparative example for this embodiment. In this embodiment, a restriction 620 has a nearly hemispherical shape with the top cut off along a plane perpendicular to the rotational axis L. That is, the restriction 620 has a convex surface 20d. The inner wall of the outlet of the suction passage 26 is widened toward the restriction 620 thus forming a tapered receiving surface 26a.

When the swash plate 15 moves to the position of the minimum inclined angle from the position of the maximum inclined angle, the restriction 620 moves backward while gradually restricting the gas-passage opening between the convex surface 20d and the receiving surface 26a. When the convex surface 20d comes into contact with the receiving surface 26a, the gas-passage area between both surfaces 20d and 26a becomes zero, blocking the suction passage 26 as shown in FIG. 26(*a*). That is, the restriction 620 serves as the shutter member 21 in this embodiment. More specifically, the convex surface 20d of the restriction 620 serves as the shuttering surface 21e in the embodiment shown in FIG. 1, while the receiving surface 26a serves as the positioning surface 27.

Figure 26A:
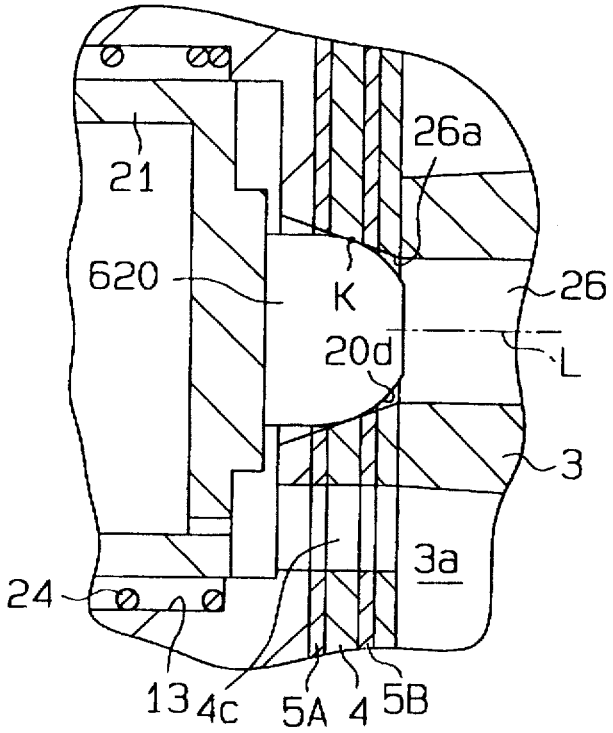
FIGS. 26(*a*) and 26(*b*) are enlarged partial cross-sectional views of a different embodiment, FIG. 26(*a*) showing the suction passage in an open state while FIG. 26(*b*) shows the suction passage closed.
Figure 26B:
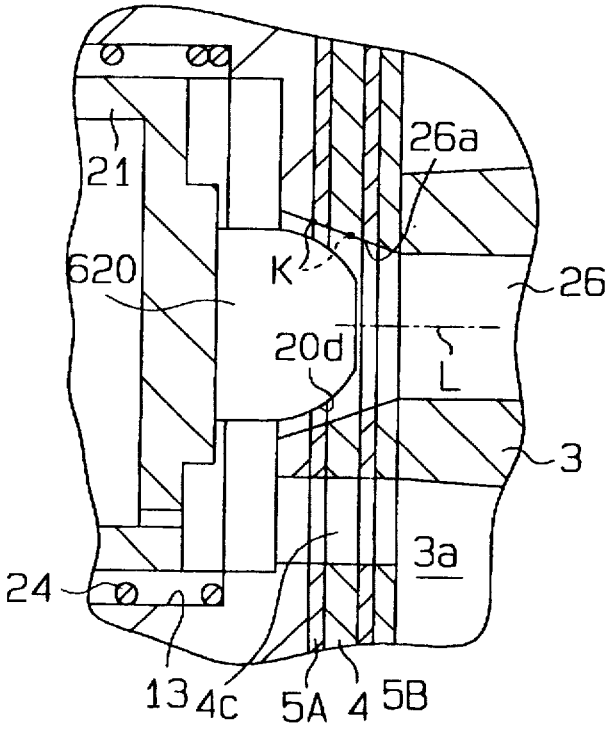

When the swash plate 15 moves toward the position of the maximum inclined angle from the position of the minimum inclined angle as shown in FIG. 26(*b*), on the other hand, the restriction 620 moves away from the receiving surface 26a, so that the open gas-passage area between the convex surface 20d and the receiving surface 26a gradually increases.

As is apparent from FIG. 28, for example, for the structure in which no receiving surface is provided in a suction passage 61 and a restriction 60 does not engage with the inner wall of a suction passage 61, the outside diameter ra of the restriction should be set slightly smaller than the inside diameter Ra of the suction passage 61, even in consideration of the dimensional tolerance, to permit the smooth entrance of the restriction 60 into the passage 61. Therefore, even when the restriction 60 is hidden in the suction passage 61 and a shuttering surface 62 abuts on a positioning surface 63 to close the outlet of the suction passage 61, making the cross-sectional area of the passage zero, the open gas-passage area does not become zero in the gap between the restriction 60 and the inner wall of the passage 61.

Figure 27:
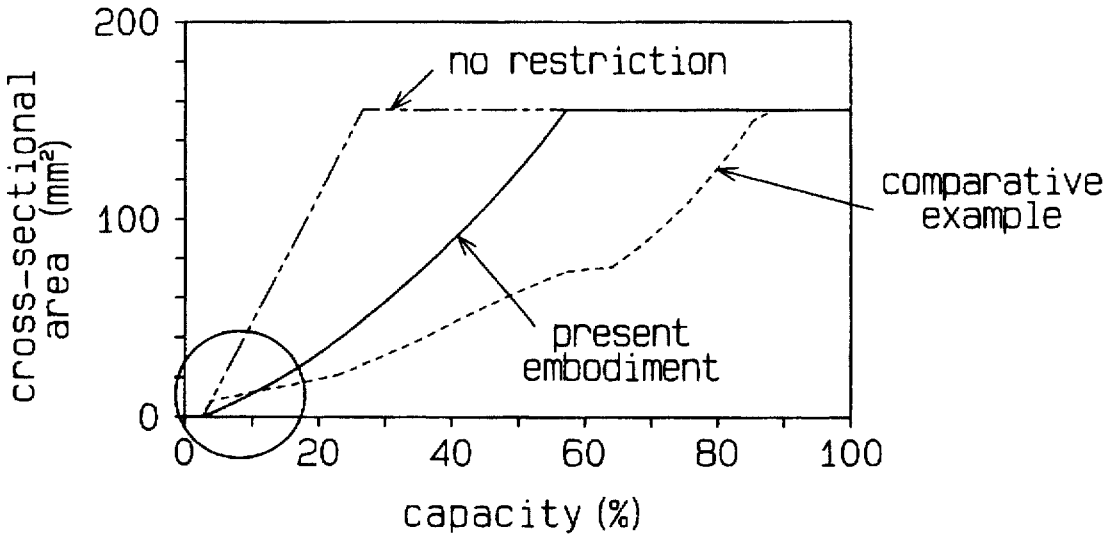
FIG. 27 is a graph showing the relationship between a change in displacement and the cross-sectional area of a passage, including an encircled portion.
Figure 27A:
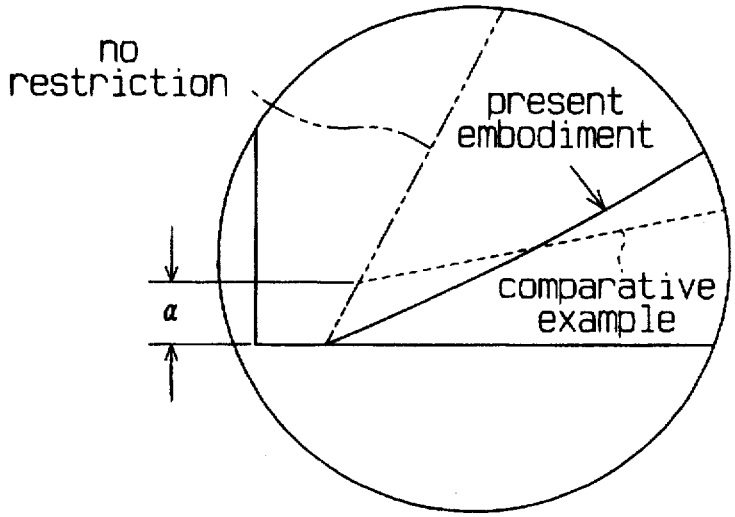
FIG. 27*a* is an enlarged showing of the encircled portion of FIG. 27.

When the opening of the suction passage 61 starts or the instant the swash plate 15 moves toward the position of its maximum incline from the position of the minimum incline, therefore, the cross-sectional area of the passage through which the gas can pass linearly increases to the cross-sectional area $\alpha(\alpha=2\pi RaX)$ from zero, where X is a distance between the positioning surface 63 and the shuttering surface 62. As shown in FIGS. 27 and 27a, therefore, the cross-sectional area of the passage through which the gas can pass may drastically increase so that it may be difficult to perform stable displacement control at the beginning of the opening of the suction passage 61. For reference purpose, the line indicated by the two-dot chain line in FIGS. 27 and 27a shows a change in the cross-sectional area of the suction passage 61 when the restriction 20 is not provided.

In this embodiment, the convex surface 20d of the restriction 620 serves as the shutter member 21 when it contacts the receiving surface 26a of the suction passage 26. When the suction passage 26 is blocked, therefore, the cross-sectional area of the restricted portion can be set to zero, and the cross-sectional area of the restricted portion at the beginning of the opening of the suction passage 26 increases slowly from zero as indicated by the solid line in FIGS. 27 and 27a. This embodiment can therefore suppress a drastic increase in the open gas-passage area as compared with the example shown in FIG. 28.

When the shutter member 21 moves forward, the point K where the restriction 620 comes closest to the receiving surface 26a also moves in the same direction. In other words, the amount of the relative movement between this point K and the shutter member 21 is smaller than the actual amount of movement of the shutter member 21, and the amount of the increase in the gap between the receiving surface 26a and the restriction 620 is not proportional to the amount of movement of the shutter member 21. When the opening of the suction passage 26 starts, therefore, the degree of the increase in the cross-sectional area of the passage through which the gas can pass is suppressed. This will suppress a rapid increase in the open gas-passage area.

According to this embodiment, as discussed above, even at the beginning of the opening of the suction passage 26, a drastic increase in the cross-sectional area of the open gas-passage area and a drastic increase in the load torque of the compressor are reduced.

Further, the provision of the convex surface 20d on the restriction 620 allows the cross-sectional area of the open gas-passage area to increase gradually before the restriction 620 comes out of the suction passage 26. This ensures stable displacement control even after the opening of the suction passage 26 starts.

Furthermore, the restriction 620 in this embodiment abuts on the receiving surface 26a at the middle part of the convex surface 20d. The force at the time of the abutment is therefore spread out, suppressing any damages to the restriction 620 and the receiving surface 26a and thus increasing their service lives.

What is more, the restriction 620 comes into line contact with the receiving surface 26a at a part of the convex surface 20d, which improves the sealing therebetween. Therefore, the convex surface 20d and the receiving surface 26a can have greater allowances, which facilitates manufacturing.

The present invention may also be embodied in the following forms without departing from the scope and spirit of this invention.

(1) In the above-described embodiment, the restriction 620 may be formed in a hollow shape.

(2) The receiving surface 26a may have a concave surface of a greater curvature than that of the convex surface 20d.

(3) In the above-described embodiment, another restriction may be added to the distal end of the restriction 620 so that after the convex surface 20d of the restriction 620 comes out of the retaining hole 13, the additional restriction is positioned in the retaining hole 13. With this structure, the stable restricting action can be provided over the entire displacement area.

What is claimed is:

1. A compressor having an internal refrigerant gas passage selectively connected to and disconnected from an external refrigerant circuit separately provided from the compressor, said compressor having a reciprocable piston in a cylinder bore formed in a housing for compressing gas supplied from the external refrigerant circuit to the internal refrigerant gas passage, said compressor comprising:

a drive shaft rotatably supported by the housing;

a swash plate supported on the drive shaft for integral rotation with and inclining motion with respect to the drive shaft, said swash plate being movable between a maximum inclined angle and a minimum inclined angle;

disconnecting means for disconnecting the internal refrigerant gas passage from the external refrigerant circuit when the swash plate is at the minimum inclined angle; and restricting means for restricting the amount of gas to be passed through the internal refrigerant gas passage in association with the disconnecting means when the swash plate moves.

2. A compressor according to claim 1 further comprising control means for detecting the pressure of the gas in the internal refrigerant gas passage to control the inclined angle of the swash plate in response to the pressure in the internal refrigerant gas passage.

3. A compressor according to claim 2, wherein said disconnecting means is disposed downstream of a position where said control means detects the pressure in the internal refrigerant gas passage.

4. A compressor having an internal refrigerant gas passage selectively connected to and disconnected from an external refrigerant circuit separately provided from the compressor, said compressor having a plurality of reciprocable pistons for compressing gas supplied from the external refrigerant circuit to the internal refrigerant gas passage, said compressor comprising:

a housing having a discharge chamber and a suction chamber;

a crank chamber defined in the housing;

a plurality of cylinder bores formed in the housing, each cylinder bore communicating with the discharge chamber and the suction chamber and accommodating each piston;

a drive shaft rotatably supported by the housing;

a swash plate supported on the drive shaft for integral rotation with and inclining motion with respect to the drive shaft, said swash plate being movable between a maximum inclined angle and a minimum inclined angle;

disconnecting means for disconnecting the internal refrigerant gas passage from the external refrigerant circuit when the swash plate is at the minimum inclined angle; and restricting means for restricting an amount of the gas to be passed through the internal refrigerant gas passage in association with the disconnecting means when the swash plate moves.

5. A compressor according to claim 4, wherein said internal refrigerant gas passage includes:

a first passage for connecting the crank chamber and the suction chamber to deliver the refrigerant gas from the crank chamber to the suction chamber;

a second passage for connecting the discharge chamber and the crank chamber to deliver the refrigerant gas from the discharge chamber to the crank chamber; and a circulating passage including the first and the second passages, said circulating passage being formed upon disconnection of the external refrigerant circuit from the internal refrigerant gas passage.

6. A compressor according to claim 5 further comprising:

a suction passage for connecting the external refrigerant circuit and the internal refrigerant gas passage; and an exhaust port for connecting the discharge chamber to the external refrigerant circuit to deliver the refrigerant gas from the discharge chamber to the external refrigerant circuit.

7. A compressor according to claim 5 further comprising a restrictor passage for delivering the refrigerant gas from the discharge chamber to the crank chamber.

8. A compressor according to claim 5 further comprising a valve for selectively opening and closing the second passage in response to operational conditions of the compressor.

9. A compressor according to claim 8, wherein said valve includes an electromagnetic valve.

10. A compressor according to claim 9 further comprising a computer for controlling the electromagnetic valve in response to signals indicative of the operational conditions of the compressor.

11. A compressor according to claim 4 further comprising a suction passage for connecting the external refrigerant circuit and the internal refrigerant gas passage.

12. A compressor according to claim 11, wherein said disconnecting means selectively opens and closes the suction passage.

13. A compressor according to claim 12, wherein said disconnecting means includes:

a shutter member movable along the internal refrigerant gas passage between a first position where the shutter member opens the suction passage and a second position where the shutter member closes the suction passage;

a spring for urging the shutter member toward the first position; and a regulating member for regulating the shutter member at the second position when the shutter member moves toward the second position.

14. A compressor according to claim 13, wherein said housing has a shutter chamber for accommodating the shutter member, and said shutter chamber communicates with the suction passage.

15. A compressor according to claim 14, wherein said shutter member has a substantially cylindrical shape and a closed end;

said drive shaft has a front end and a rear end; and said compressor further comprises a front bearing and a rear bearing for respectively supporting the front end and the rear end, said rear bearing being disposed within the shutter member.

16. A compressor according to claim 11, wherein said restricting means is movable between an inactive position where the restricting means is located apart from the suction passage and an active position where said restricting means enters into the suction passage to reduce the cross-sectional area of the suction passage.

17. A compressor according to claim 13, wherein said restricting means includes a projection extending from the shutter member, said projection being located at an inactive position when the restricting means is located apart from the suction passage and said shutter member is located at the first position and being located at an active position where said restricting means enters into the suction passage to reduce the cross-sectional area of the suction passage when the shutter member is located at the second position.

18. A compressor according to claim 17, wherein said projection has a cylindrical proximal section having a cross-sectional area smaller than the cross-sectional area of the suction passage and a conical distal section.

19. A compressor according to claim 17, wherein said projection is cylindrical and has an outer diameter substantially equal to the inner diameter of the suction passage and a groove formed on the outer periphery of the projection to extend along the longitudinal direction of the projection.

20. A compressor according to claim 17, wherein said projection has a cylindrical wall, said wall having an outer diameter substantially equal to the inner diameter of the suction passage and a slit communicating with and enlarged toward the suction passage.

21. A compressor according to claim 17, wherein said projection has a convex distal section and said suction passage has an opening enlarged toward the distal section, and wherein said distal section moves between an inactive position where the distal section is located apart from the opening and an active position where the distal section engages an inner surface of the opening to close the suction passage.

22. A compressor according to claim 17, wherein said projection has an outer surface the diameter of which is reduced toward the distal section.

23. A compressor having an internal refrigerant gas passage selectively connected to and disconnected from an external refrigerant circuit separately provided from the compressor, said compressor having a plurality of reciprocable pistons for compressing gas supplied from the external refrigerant circuit to the internal refrigerant gas passage, said compressor comprising:

a housing having a discharge chamber and a suction chamber;

a suction passage formed in the housing for connecting the external refrigerant circuit and the internal refrigerant gas passage;

a crank chamber defined in the housing;

a drive shaft rotatably supported by the housing; a plurality of cylinder bores defined in the housing, each cylinder bore communicating with the discharge chamber and the suction chamber and accommodating each piston;

a swash plate supported on the drive shaft for integral rotation with and inclining motion with respect to the drive shaft, said swash plate being movable between a maximum inclined angle and a minimum inclined angle;

disconnecting means for disconnecting the internal refrigerant gas passage from the external refrigerant circuit when the swash plate is at the minimum inclined angle, said disconnecting means including:

a shutter member movable along the internal refrigerant gas passage between a first position where the shutter member opens the suction passage and a second position where the shutter member closes the suction passage;

a spring for urging the shutter member toward the first position; and a regulating member for regulating the shutter member at the second position when the shutter member moves toward the second position; and restricting means for restricting the amount of gas to be passed through the internal refrigerant gas passage in association with the disconnecting means when the swash plate moves, said restricting means including:

a projection extending from the shutter member, said projection being located at an inactive position when the projection is located apart from the suction passage and said shutter member is located at the first position and being located at an active position where the projection enters into the suction passage to reduce a cross-sectional area of the suction passage when the shutter member is located at the second position.

* * * * *